US008864691B2

(12) United States Patent
Olson et al.

(10) Patent No.: US 8,864,691 B2
(45) **Date of Patent: *Oct. 21, 2014**

(54) APPARATUS, SYSTEMS, AND METHODS FOR AUGMENTING THE FLOW OF FLUID WITHIN BODY VESSELS

(75) Inventors: Jonathan M. Olson, San Jose, CA (US); Salvatore G. Mangano, Menlo Park, CA (US); Brendan M. Donohoe, Fairfax, CA (US); Peter K. Johansson, Lafayette, CA (US); Richard A. Lotti, Santa Cruz, CA (US); Thomas J. Fogarty, Portola Valley, CA (US)

(73) Assignee: Venous Health Systems, Inc., San Jose, CA (US)

( * ) Notice: Subject to any disclaimer, the term of this patent is extended or adjusted under 35 U.S.C. 154(b) by 458 days.

This patent is subject to a terminal disclaimer.

(21) Appl. No.: 12/966,088

(22) Filed: Dec. 13, 2010

(65) Prior Publication Data

US 2012/0089059 A1 Apr. 12, 2012

Related U.S. Application Data

(60) Provisional application No. 61/404,943, filed on Oct. 12, 2010.

(51) Int. Cl.
*A61H 9/00* (2006.01)
*A61H 7/00* (2006.01)

(52) U.S. Cl.
CPC ..... *A61H 9/0078* (2013.01); *A61H 2201/1238* (2013.01); *A61H 2209/00* (2013.01); *A61H 2201/501* (2013.01); *A61H 2201/5007* (2013.01); *A61H 2201/5071* (2013.01); *A61H 2201/164* (2013.01); *A61H 2201/5043* (2013.01); *A61H 2201/165* (2013.01); *A61H 2201/5015* (2013.01); *A61H 9/0092* (2013.01); *A61H 2201/169* (2013.01)
USPC ..... 601/152; 601/149; 601/150

(58) Field of Classification Search
CPC ..... A61H 2201/165; A61H 2201/0103; A61H 2201/1238; A61H 2201/5007; A61H 2201/0157; A61H 2201/5043; A61H 2201/164; A61H 2201/5071; A61H 2201/169; A61H 2201/5015; A61H 9/0078; A61H 9/0092; A61H 2205/10; A61H 2205/106; A61H 2209/00
USPC ..... 128/DIG. 20; 601/148–152; 602/13; 606/201–202; D24/200
See application file for complete search history.

(56) References Cited

U.S. PATENT DOCUMENTS 5,156,629 A * 10/1992 Shane et al. ..... 623/37
5,383,842 A * 1/1995 Bertini ..... 601/151
5,443,440 A * 8/1995 Tumey et al. ..... 601/152

(Continued)

OTHER PUBLICATIONS

International Search Report and Written Opinion of International Searching Authority dated Jan. 23, 2012, in International Appln No. PCT/US2011/055889.

*Primary Examiner* — Justine Yu
*Assistant Examiner* — Douglas Sul
(74) *Attorney, Agent, or Firm* — Ryan Kromholz & Manion, S.C.

(57) ABSTRACT

Apparatus, systems, and methods are sized and configured to effectively and efficiently augment the flow of fluid within body vessels, not only during conditions in which a patient is bedbound and immobile, but also in conditions when the individual is out of bed, and completely mobile and ambulatory.

18 Claims, 17 Drawing Sheets

(56) References Cited

U.S. PATENT DOCUMENTS

| | | | | |
|---|---|---|---|---|
| 6,001,119 | A * | 12/1999 | Hampson et al. | 606/202 |
| 6,010,470 | A | 1/2000 | Albery et al. | |
| 6,212,719 | B1 * | 4/2001 | Thomas et al. | 5/713 |
| 6,409,691 | B1 * | 6/2002 | Dakin et al. | 602/5 |
| 6,960,159 | B2 * | 11/2005 | Chung et al. | 600/15 |
| 7,591,796 | B1 | 9/2009 | Barak et al. | |
| 2002/0022791 | A1 * | 2/2002 | Morris et al. | 601/149 |
| 2004/0054306 | A1 * | 3/2004 | Roth et al. | 601/152 |
| 2005/0107725 | A1 * | 5/2005 | Wild et al. | 601/152 |
| 2011/0245743 | A1 * | 10/2011 | Eddy | 601/151 |

* cited by examiner (Full Treatment Mode)

(Ambulatory Mode)

(Full Treatment Mode)

(Ambulatory Mode)

(Right Limb)

(Right Limb)

(Full Treatment Mode)

(Ambulatory Mode)

(Left Limb)

(Left Limb)

Full Treatment Mode (Foot Compression State)

Full Treatment Mode (Calf Compression State)

Full Treatment Mode (Calf Compression State)

Full Treatment Mode (Vent State)

Ambulatory Treatment Mode (Calf Compression State)

Ambulatory Treatment Mode (Calf Compression State)

Ambulatory Treatment Mode (Vent State)

APPARATUS, SYSTEMS, AND METHODS FOR AUGMENTING THE FLOW OF FLUID WITHIN BODY VESSELS

RELATED APPLICATION

This application claims the benefit of U.S. Provisional Patent Application Ser. No. 61/404,943, filed Oct. 12, 2010, entitled Apparatus, Systems, and Methods for Augmenting the Flow of Fluid Within Body Vessels.

FIELD OF THE INVENTION

The invention generally relates to therapeutic apparatus, systems, and methods for augmenting the flow of fluid within body vessels.

BACKGROUND OF THE INVENTION

Many diverse therapeutic indications exist in which augmenting the flow of fluid within a body vessel is required or at least clinically beneficial. Inadequate blood and fluid flow in regions of the body can lead to pain, tissue swelling, edema, prolonged wound healing time, and forms of stasis, such as leg swelling; stasis dermatitis; stasis ulcers; arterial and diabetic skin ulcers; and other conditions of skin irritation and breakdown (ulcer) due to the accumulation of fluid under the skin resulting from poor blood and fluid circulation. Fluid leaks from the veins into skin tissue when blood backs up rather than returning to the heart through the veins.

Deep Vein Thrombus (DVT) is another example in which augmenting the flow of fluid within a body vessel is clinically important. DVT is the formation of a blood clot in a deep vein. Blood clots (thrombus) form in regions of slow moving or disturbed blood flow, usually in the large veins of the legs, leading to partial or completely blocked blood circulation. DVT has the potential to create a deadly pulmonary embolism (PE) if the blood clot were to separate from the venous wall and become lodged in the patient's lung.

DVT is a very preventable disease even in high risk populations, because the disease is primarily linked to poor or compromised blood flow. Maintaining good blood flow through increasing the velocity of the blood in the peripheral venous network should reduce disease incidents.

VT and PE can be asymptomatic, or may have symptoms like tenderness to the leg or arm in the DVT location, pain, swelling of tissue surrounding the DVT location or discoloration and redness, unexplained shortness of breath, chest pain, anxiety, coughing up blood. DVT incidences range from 200,000 to 600,000 patients per year.

Risk factors for DVT and potential PE include increased age, immobility, obesity, stroke, paralysis, cancer and treatments, major surgery (particularly surgery of the extremities or abdomen), varicose veins, and others.

There are two forms of prophylaxis for DVT prevention. One is drug-based, and the other is device-based.

Pharmalogical anticoagulants impair the normal clotting process within the blood stream of the deep veins. These are successful at preventing clot formation but have drawbacks such as patient drug allergies, medication side effects, increase surgical site bleeding.

Device-based prophylaxis is designed to increase the blood velocity or aid in blood movement through the venous network. Pneumatic compression has been the most studied and appears to be an effective therapeutic technique. These systems are very good at assisting the blood return system in compromised individuals. Draw backs include large and bulky systems that discourage patient mobility and reduce patient compliance. Convention pneumatic compression systems are cumbersome, noisy, and require external power sources, making them suitable only for non-ambulatory patients. Such systems have been associated with poor compliance in trauma patients in a hospital setting, and the poor compliance was associated with a higher rate of DVT.

Technical Features of the Invention

The invention provides apparatus, systems, and methods that are sized and configured to effectively and efficiently augment the flow of fluid within body vessels. The apparatus, systems, and methods are sized and configured to not only provide therapy during conditions in which a patient is bedbound and immobile, but also continue to provide therapy in conditions when the individual is out of bed, and completely mobile and ambulatory. The apparatus, systems, and methods are not constrained to bedside or cart mounting arrangements. The apparatus, systems, and methods are sized and configured to ambulate with the individual, when desired. The apparatus, systems, and methods make possible a therapy that is completely effective and also completely mobile.

According to one representative aspect of the invention, the apparatus, systems, and methods are sized and configured specifically for the treatment of DVT in the lower extremities of the foot and leg. In this arrangement, the apparatus, systems, and methods include a garment sized and configured to be comfortably worn on an individual's calf and foot. The garment includes an interior pneumatic network of formed multiple inflation cells. The inflation cells are sized and configured to provide a reduced fluid volume without loss to applied compressive force. The apparatus, systems, and methods also include a control module, which houses a self-contained, miniaturized source of pneumatic fluid pressure for the cells. The module carrying the miniaturized source of pneumatic pressure can be directly attached to the garment. The module carrying the miniaturized source of pneumatic pressure rides along with the garment as the individual moves about. The module also carries a miniaturized self-contained controller for the pneumatic fluid source. The controller directs pressurized pneumatic fluid in a purposeful way into the inflation cells. The size and configuration of the cells provide sequential compression forces to the limbs (calf and foot), to increase the blood velocity within the deep venous network. In this particular representative embodiment, the apparatus, systems, and methods apply compression on the foot to mimic the natural blood return benefits seen during walking, while also applying compression of the larger vessels within the calf, thereby targeting major sections of the body were DVT development occurs.

The foregoing aspect is but one specific example representative of the broader aspects of the invention. The invention provides a purposeful size and configuration for a pneumatic pressure distribution network. The network provides a reduced fluid volume system, without a loss of applied compressive forces. The apparatus, systems, and methods representative of the invention make it possible to place a clinically effective pneumatic pressure distribution network within a garment that can be comfortably worn by an individual. The apparatus, systems, and methods representative of the invention further make it possible to mount on the garment itself a self-contained, miniaturized pressurized pneumatic fluid source and controller, which go where ever the individual wants to go during therapy. In these broader aspects, the invention provides for diverse therapeutic indications—in which DVT is representative but not exclusive—apparatus, systems, and methods that augment the flow of fluid within body vessels in a manner that complements and enhances the overall treatment for an individual. The apparatus, systems, and methods provide effective prophylaxis that is a necessary part of the therapy, but is not an unwelcomed hindrance to the individual's mobility and quality of life. Compliance of therapy increases exponentially when an individual does not have to sacrifice their mobility and quality of life during treatment. It is this unique form of therapy compliance that the apparatus, systems, and methods of the invention make possible.

These and other aspects of the invention will be made clear by the description and examples that follow.

DESCRIPTION OF THE PREFERRED EMBODIMENTS

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

FIG. 1 shows a system 10 for augmenting the flow of fluid within a vessel in a region of a body. For the purpose of illustration, the system 10 will be described in the context of increasing the velocity of blood in the peripheral venous network of an individual, and, in particular, in a limb of an individual as a prophylaxis for the prevention of DVT.

Still, it should be appreciated that the apparatus, systems, and methods, which will be described in this particular context, are not limited in their application to the treatment of DVT, or even to the augmentation of venous blood flow itself. The apparatus, systems, and methods that will be described are applicable to diverse situations in which it is desired to increase the velocity of fluid within a region body over a resting state velocity. These include, but are not limited to, in addition to DVT, enhancing blood circulation in general; diminishing post-operative pain and swelling; reducing wound healing time; treatment and assistance in healing, e.g., stasis dermatitis, venous stasis ulcers, and arterial and diabetic leg ulcers; treatment of chronic venous insufficiency; and reducing edema.

I. The System

A. Overview

The system 10 includes three principal components.

Figure 9:
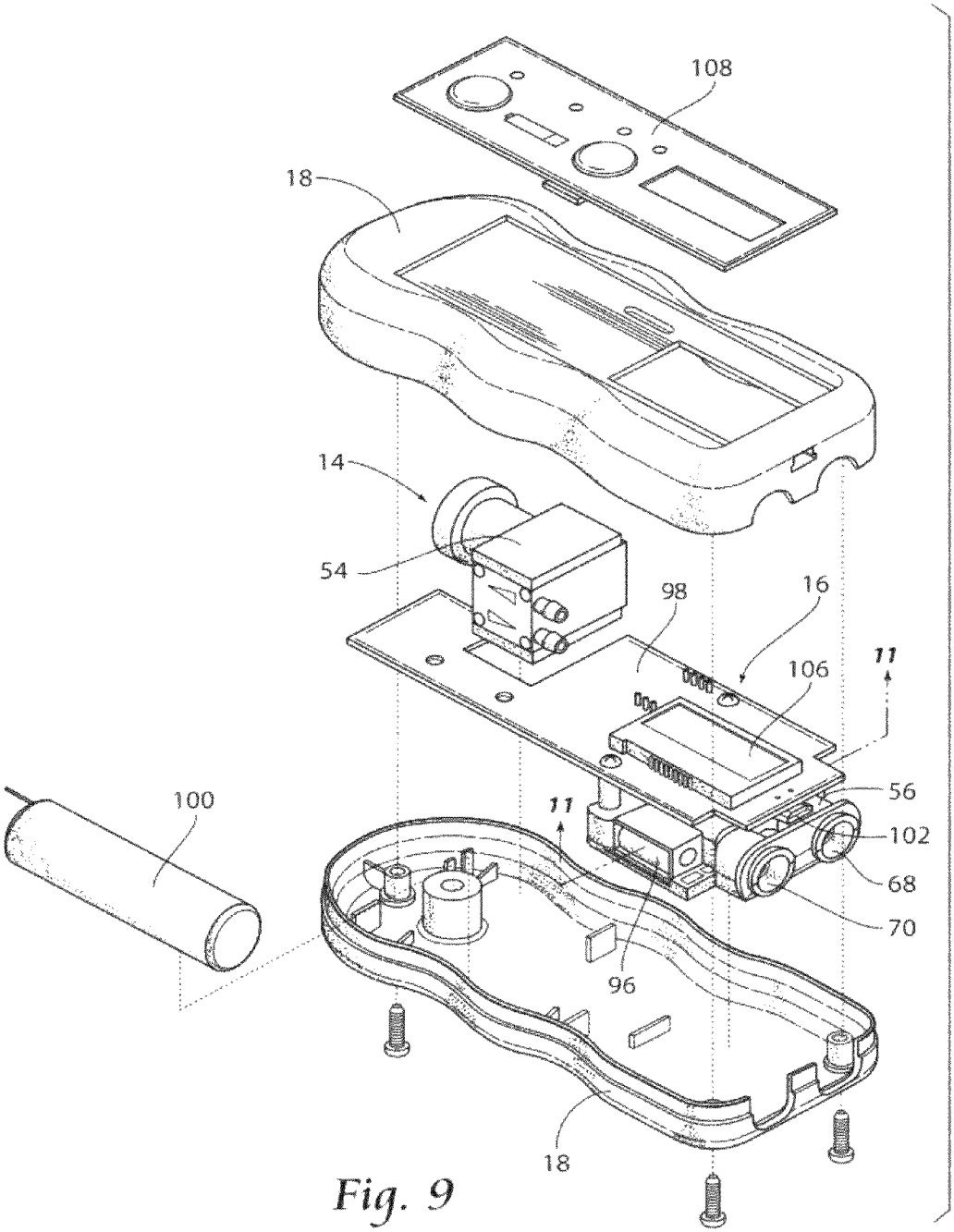
FIG. 9 is an exploded perspective view of the control module shown in FIGS. 7 and 8A, showing the self-contained pneumatic fluid source and controller housed within the control module.
Figure 10:
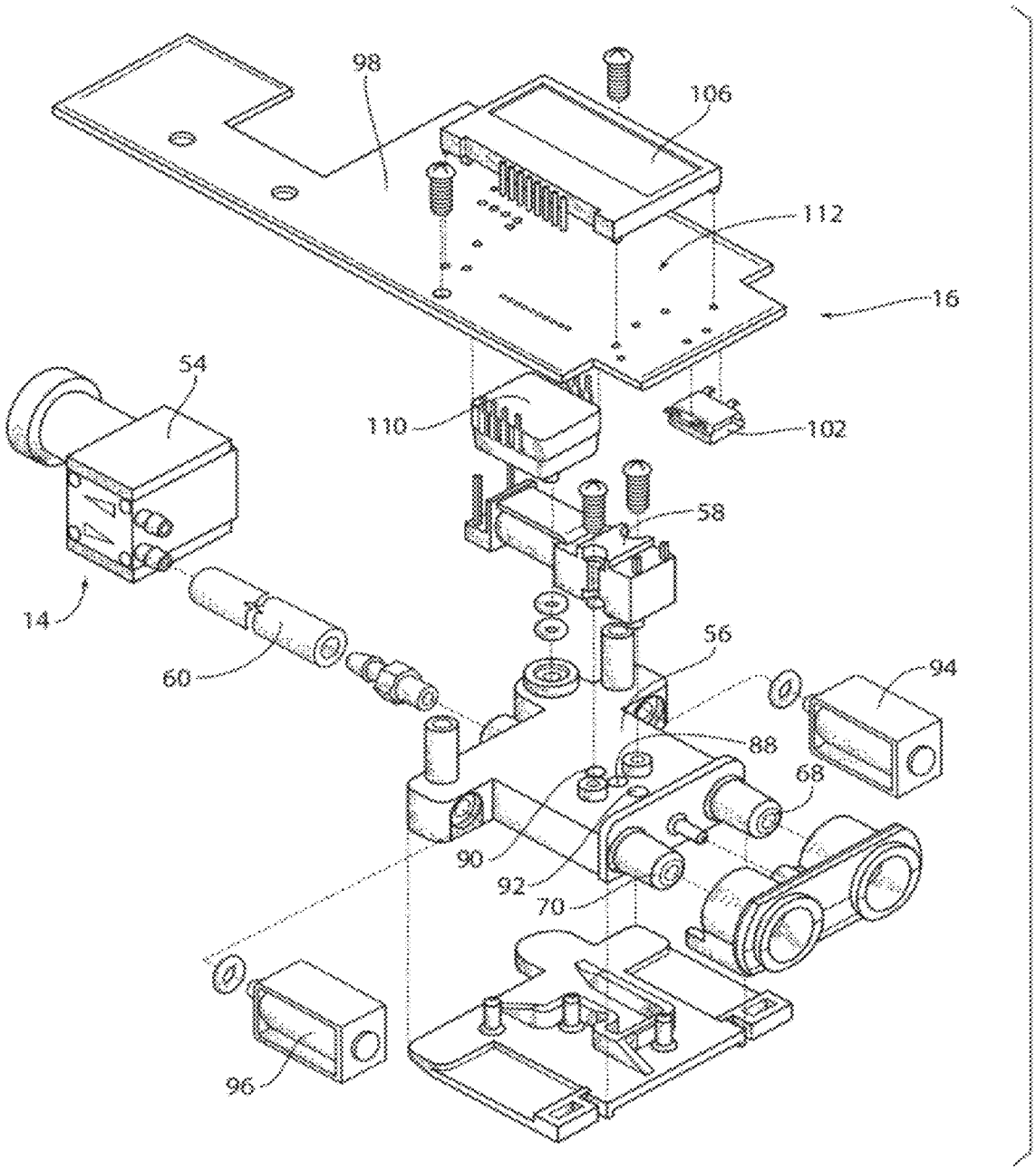
FIG. 10 is a further exploded perspective view of the pneumatic fluid source and controller housed within the control module shown in FIG. 9.

These are a pneumatic fluid distribution garment 12 (see, e.g., FIGS. 2A/2B; 3A/3B; and 4); a pneumatic fluid source 14 that interacts with the pneumatic fluid distribution garment 12 (see, e.g., FIG. 9); and a controller 16 that governs the interaction to perform a selected venous blood flow augmentation protocol (see, e.g., FIG. 10). In the illustrated embodiment, the pneumatic fluid source 14 and the controller 16 are located wholly within a common control module 18 (see, e.g., FIGS. 4; 7; and 8), which can comprise, e.g., molded plastic. The control module 18 is itself carried wholly by the pneumatic fluid distribution garment 12 (see FIGS. 1; 2A/2B; and 3A/3B). The control module 18 is detachable from the garment 12 (see, e.g., FIG. 4), when desired, as will be described in greater detail later.

The pneumatic fluid source 14 is intended to be a durable item capable of long term, maintenance free use. The pneumatic fluid source 14 is characterized as being self-contained, lightweight, and portable. The pneumatic fluid source 14 presents a compact footprint, suited for operation while wholly carried during use by the pneumatic fluid distribution garment 12. The pneumatic fluid source 14 is desirably battery powered, requiring no external cables coupled to an external power source to operate. When it is required change or recharge the battery, the pneumatic fluid source 14 can be readily separated from the pneumatic fluid distribution garment 12, as FIG. 4 demonstrates.

The pneumatic fluid distribution garment 12 is intended to be a limited use, essentially disposable item. In the illustrated embodiment, the pneumatic fluid distribution garment 12 is sized and configured to be affixed to a limb of an individual. More particularly, for the purpose of illustration, the limb comprises the foot and calf of an individual, so the garment 12 includes a calf region 20 and a foot region 22. It should be appreciated that a fluid distribution garment 12 having the technical features, as will be described, can be sized and configured to be affixed to other regions of the body targeted for treatment, for example, to the thigh, or arm and/or hand, and/or the shoulder.

Figure 1A:
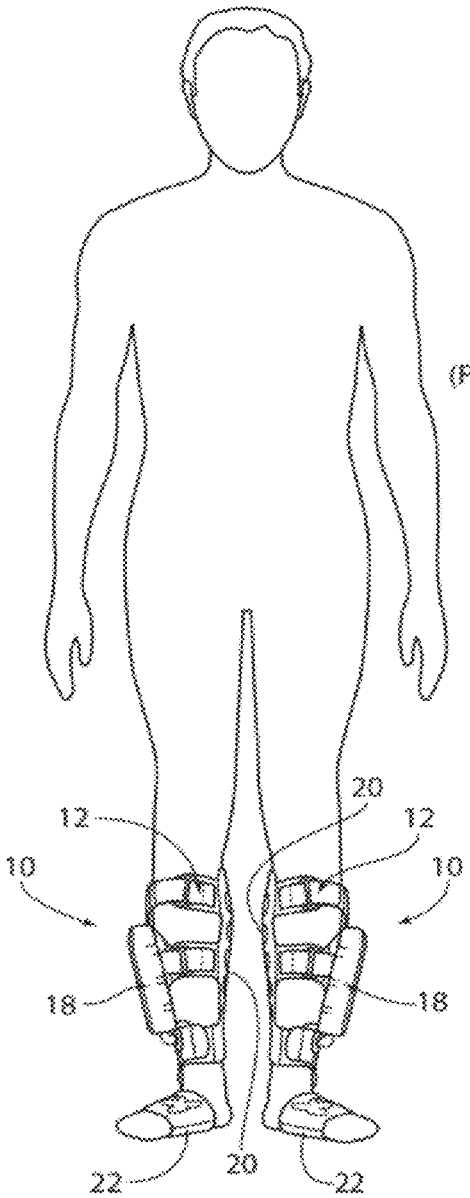
FIG. 1A is a front view of a system for augmenting the flow of fluid within a vessel in a region of a body, shown being worn by an upright adult male on the calf and foot of both left and right lower limbs.
Figure 1B:
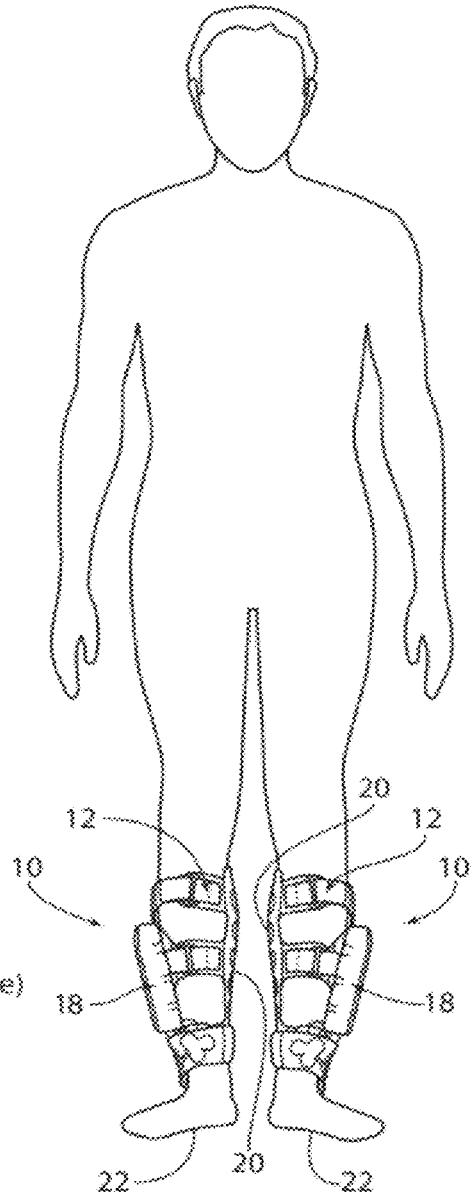
FIG. 1B is a front view of the system shown in FIG. 1A, shown being worn by an upright adult male on the calf of both left and right lower limbs.
Figure 2A:
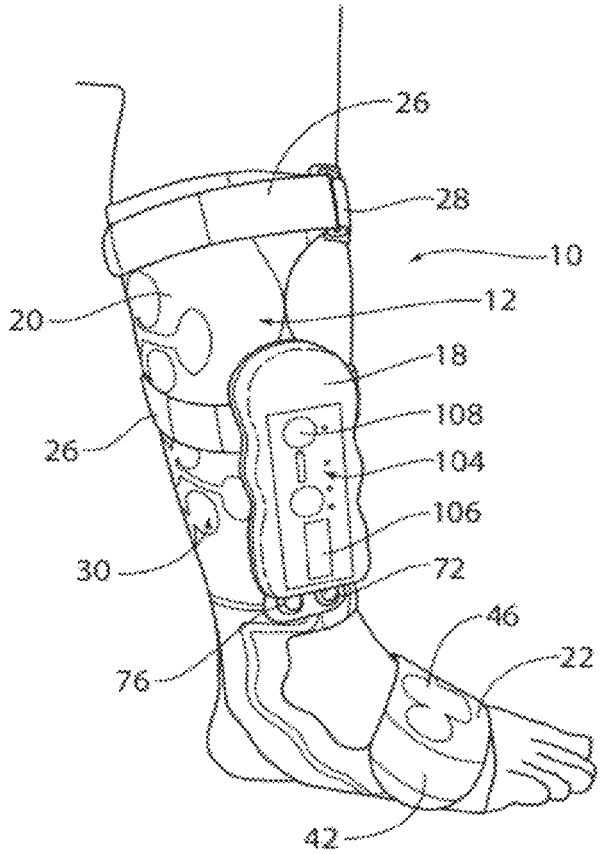
FIG. 2A is an enlarged side view of the system shown in FIG. 1A, as worn by an upright adult male on the calf and foot of the right lower limb.
Figure 2B:
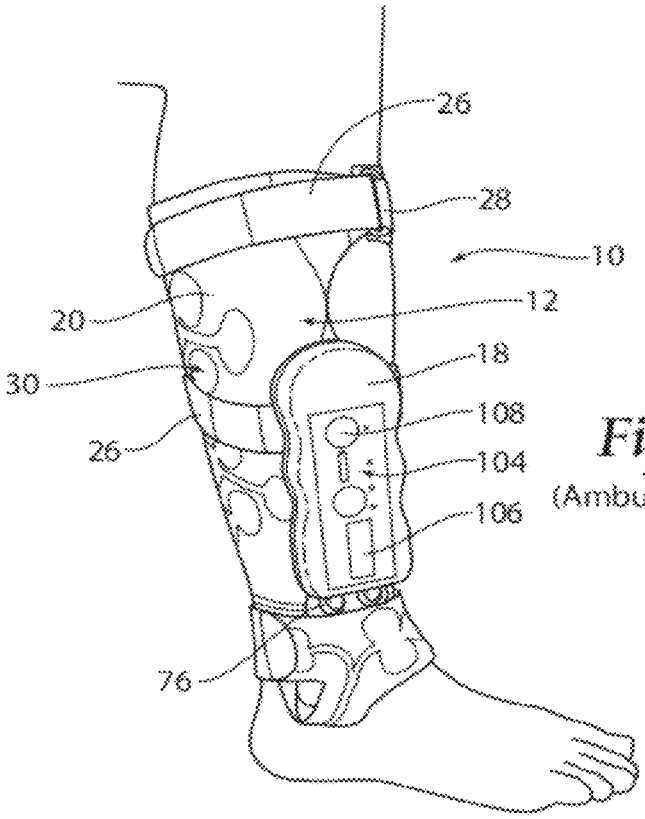
FIG. 2B is an enlarged side view of the system shown in FIG. 1B, as worn by an upright adult male on the calf of the right lower limb.
Figure 3A:
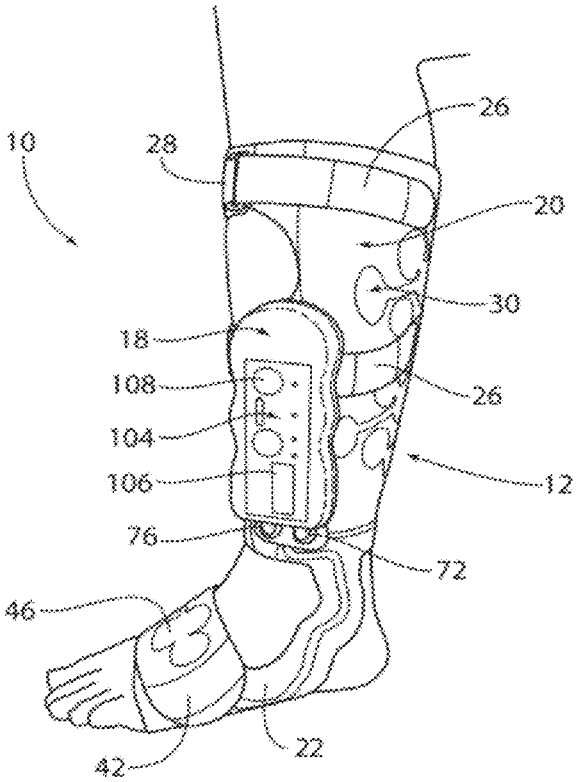
FIG. 3A is an enlarged side view of the system shown in FIG. 1A, as worn by an upright adult male on the calf and foot of the left lower limb.
Figure 3B:
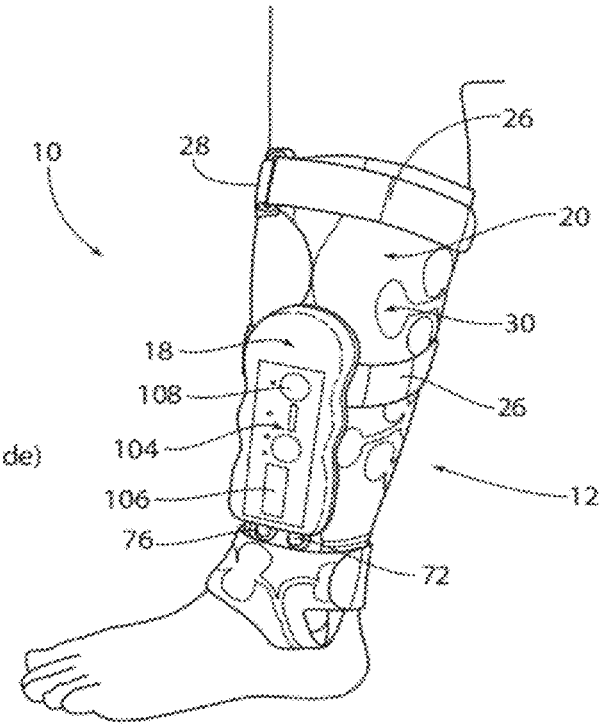
FIG. 3B is an enlarged side view of the system shown in FIG. 1B, as worn by an upright adult male on the calf of the left lower limb.

In the illustrated embodiment, before beginning a blood flow augmentation regime, the individual and/or a caregiver fits the pneumatic fluid distribution garment 12 about the targeted calf and/or foot, using attachment straps that are integral to the garment 12. The garment 12 can be worn with both calf and foot regions 20 and 22 fitted (see FIGS. 1A; 2A; and 3A) (also later called the "full treatment mode"), or with only the calf region 20 fitted (see FIGS. 1B; 2B; and 3B) (also later called the "mobility treatment mode"). In FIGS. 1B, 2B, and 3B, the foot region 22 is shown not fitted and folded back on the garment 12 from contact with the foot. Alternatively (not shown), the calf region 20 and the foot region 22 can include connectors that allow the foot region 22 to be physically separated from the calf region 20. Still alternatively, and as will be described in greater detail later, the mobility treatment mode can be accomplished strictly pneumatically, by having the controller 16 condition the pneumatic fluid source 14 to supply pneumatic fluid only to the calf region 20 and not to the foot region 22. In this arrangement, the foot region 22 is sized and configured to permit unimpeded walking while being worn on the foot without the distribution of pneumatic fluid pressure to it. Greater mobility is facilitated when pneumatic fluid is not distributed to the foot region 22 (during which walking provides natural blood return benefits), without compromise to the blood return augmentation provided more proximally by the calf region 20. Upon completion of the blood flow augmentation regime, the individual and/or caregiver releases the straps and removes the pneumatic fluid distribution garment 12 from the calf and/or foot, as warranted.

In the illustrated embodiment, there are two pneumatic fluid distribution garments 12. One (FIGS. 2A, 2B, and 2C) is sized and configured for attachment to the calf and/or foot of a right leg. The other (see FIGS. 3A, 3B, and 3C) is sized and configured for attachment to the calf and/or foot of a left leg. Each right and left pneumatic fluid distribution garment 12 carries its own dedicated pneumatic fluid distribution source.

In use, the controller 16 paces its respective pneumatic fluid source 14 through a prescribed series of pneumatic pressure and vent cycles. Each cycle applies quiet, reliable pneumatic pumping action under the control of the controller 16. The controller 16 directs the pneumatic fluid source 14 to convey pressurized pneumatic fluid (which, in the illustrated embodiment, is pressurized air) into the pneumatic fluid distribution garment 12, and then vents the pressurized pneumatic fluid from the garment 12 through the control module 18.

Each cycle provides a purposeful progressive compression of the blood vessels in the limb from the distal foot to the proximal calf. The purposeful progressive compression on the foot mimics the natural blood return benefits seen during walking. The purposeful progressive compression of the larger vessels within the calf mimics venous drainage of the lower limb and, in the illustrated embodiment, targets a major region of the body were DVT development occurs. In this way, blood in the peripheral venous network is urged from the foot and calf, up the limb, and toward the heart. The progressive compression augments blood flow by increasing the velocity of venous blood being returned toward the heart, compared to a resting state.

As shown in FIG. 1, the pneumatic fluid source 14 and controller 16 do not require a bedside mounting surface or a cart. The pneumatic fluid source 14 and controller 16 are supported wholly by the pneumatic fluid distribution garment 12. The pneumatic fluid source 14 also does not require a tortuous or complicated array of external tubing to convey pneumatic pressure to the pneumatic fluid distribution garment 12. The pneumatic fluid source 14 communicates via two short couplings directly with the pneumatic fluid distribution garment 12 worn by the individual.

All components of the system 10 are transported during ambulation of the individual. The ambulatory nature of the system 10 and its silent, reliable operating characteristics make the system 10 ideally suited for use either in the hospital or a rehabilitation clinic or at home.

The principal system components will now be individually discussed in greater detail.

B. The Pneumatic Fluid Distribution Garment

Each pneumatic fluid distribution garment 12, left limb and right limb, comprises overlying sheets 24 of flexible medical grade plastic materials, such as medical grade polyvinyl chloride (PVC) plastic. The outer layer can comprise, e.g., a laminate or composite of PVC and a Nylon/suede loop material, and the skin contacting layer can comprise, e.g., a laminate or composite of PVC and a Nylon non-woven material for better comfort.

As FIGS. 2B and 3B best show, the laminated or composite sheets 24 are peripherally sealed e.g., by radiofrequency welding. The sheets are sized and shaped into two contiguous regions; namely, the calf region 20 and the foot region 22. In the illustrated embodiment, the orientation of the left and right calf regions 20 and foot regions 22 are mirror images of each other.

1. The Calf Region

The calf region 20 is sized and configured to be intimately overlie the major musculature of the posterior region of the lower leg (e.g., lateral and medial heads of the gastrocnemius; soleus; fibularis longus; and fibularis brevis), commonly referred to as the calf.

Figure 2C:
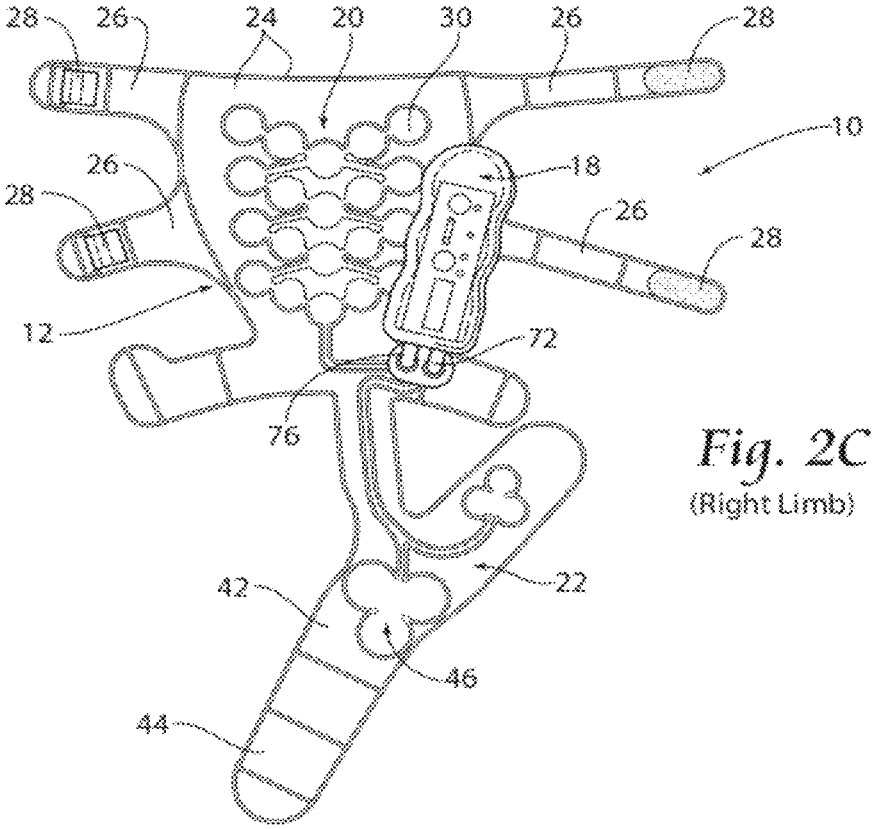
FIGS. 2C and 2D are plane views of the system shown in FIG. 1A, as the system would appear prior to being fitted to the right lower limb.
Figure 3C:
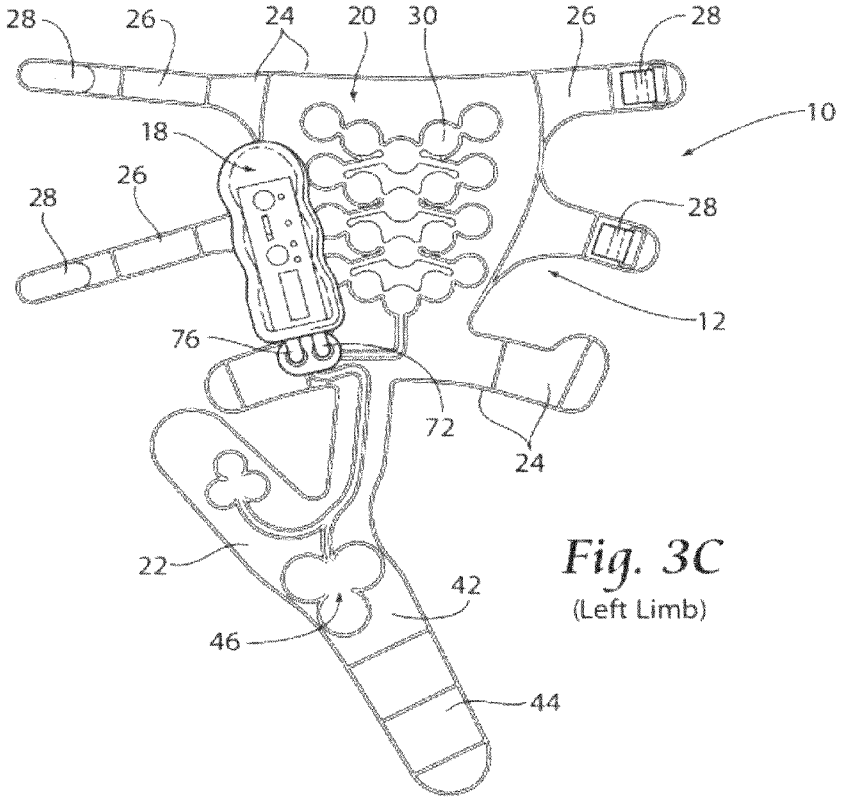
FIGS. 3C and 3D are plane views of the system shown in FIG. 1A, as the system would appear prior to being fitted to the left lower limb.
Figure 3D:
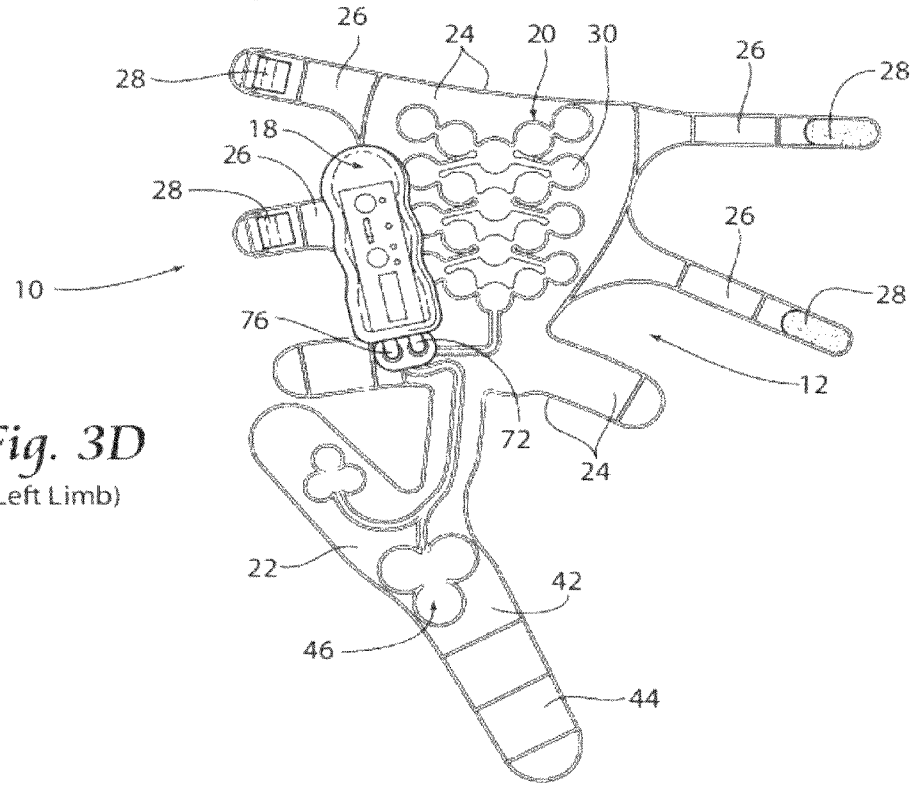

As best shown in FIGS. 2C/2D (right limb) and FIGS. 3C/3D (left limb), straps or appendages 26 extend from the calf region 20. The straps or appendages 26 carry fasteners 28, such as, e.g., snaps, magnets, buckles, straps, VELCRO® fabric, and the like. The fasteners 28 mate across the anterior of the lower leg. The fasteners 28 allow the individual to adjust the fit and form of the calf region 20 overlying the calf. When properly positioned on the calf, the calf region 20 overlies, e.g., the great and small saphenous veins, posterior tibial veins, and associated perforating veins.

In one embodiment shown in FIGS. 2C (right limb) and 3C (left limb), elongated straps 26 with the fasteners 28 comprising VELCRO® fabric extending from the interior edge of calf region 20 mate across the anterior of the limb with buckles carried on shorter straps extending from an exterior edge of the calf region 20. In this arrangement, the straps 26 are fitted over the anterior of the respective limb from an interior of the limb to an exterior of the limb, and the straps 26 are cinched and tightened from the exterior of the limb.

Figure 2D:
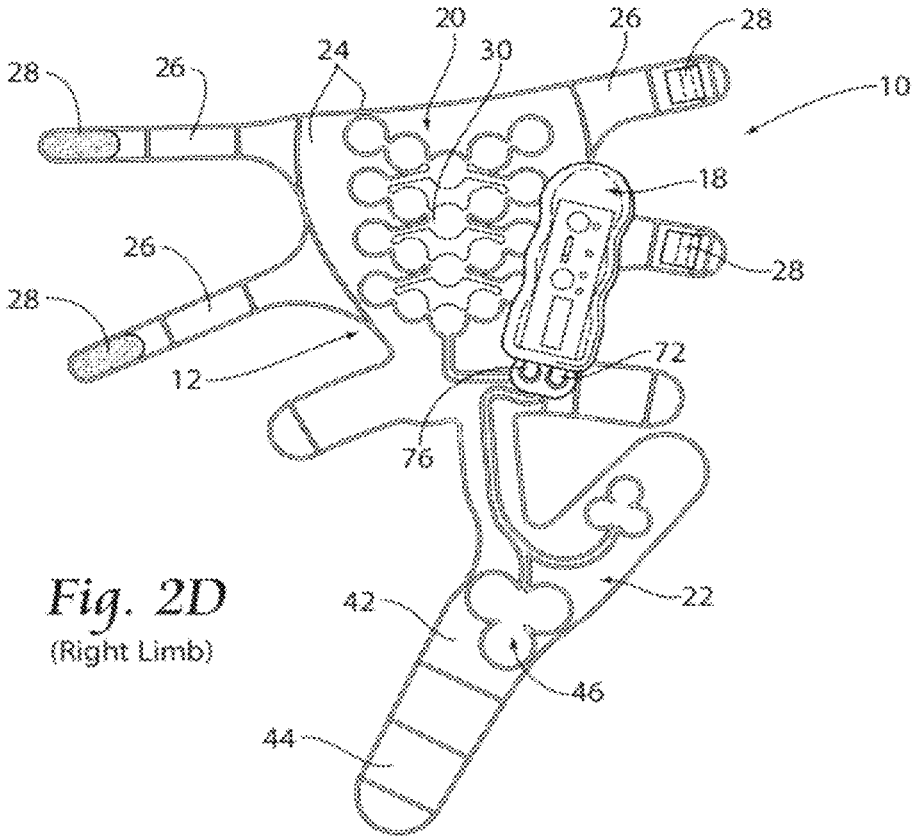

An alternative, more preferred arrangement is shown in FIGS. 2D (left limb) and 3D (right limb). In this arrangement, elongated straps 26 with the fasteners 28 comprising VELCRO® fabric extend from an exterior edge of the calf region 20, which mate across the anterior of the limb with buckles carried along an interior edge of the calf region 20. In this alternative, more preferred arrangement, the straps 26 are fitted over the anterior of the respective limb from an exterior of the limb to the interior of the limb, and the straps 26 are cinched and tightened from an interior of the limb, which is more closely aligned with the mid-line of the body and provides a more direct application of a manual cinching force for the individual.

The appendages 26 and fasteners 28 are sized and configured to provide the desired "fit" of the garment 12 to the limb. The proper fit provides consistent and direct compression to the large tissue mass of the calf. The appendages 26 and fasteners 28 desirably pull the pneumatic network of the garment 12 (as will be described) very close to the tissue without patient pain or discomfort. The size and configuration of the appendages 26 and fasteners 28 help to focus contact of the pneumatic network to the calf tissue. The size and configuration of the appendages and fasteners allow for an open feel for the garment 12, providing breathability for the contacted tissue region, but also conformity of the garment 12 to various anatomical shapes. Set-offs can be added in specific locations to provide additional contact to the anatomy as the garment 12 transverses the upper edge of the calf under the knee, where the calf muscle curves. Fit of the garment 12 against the targeted tissue is critical to successful venous velocity increases.

Figure 5A:
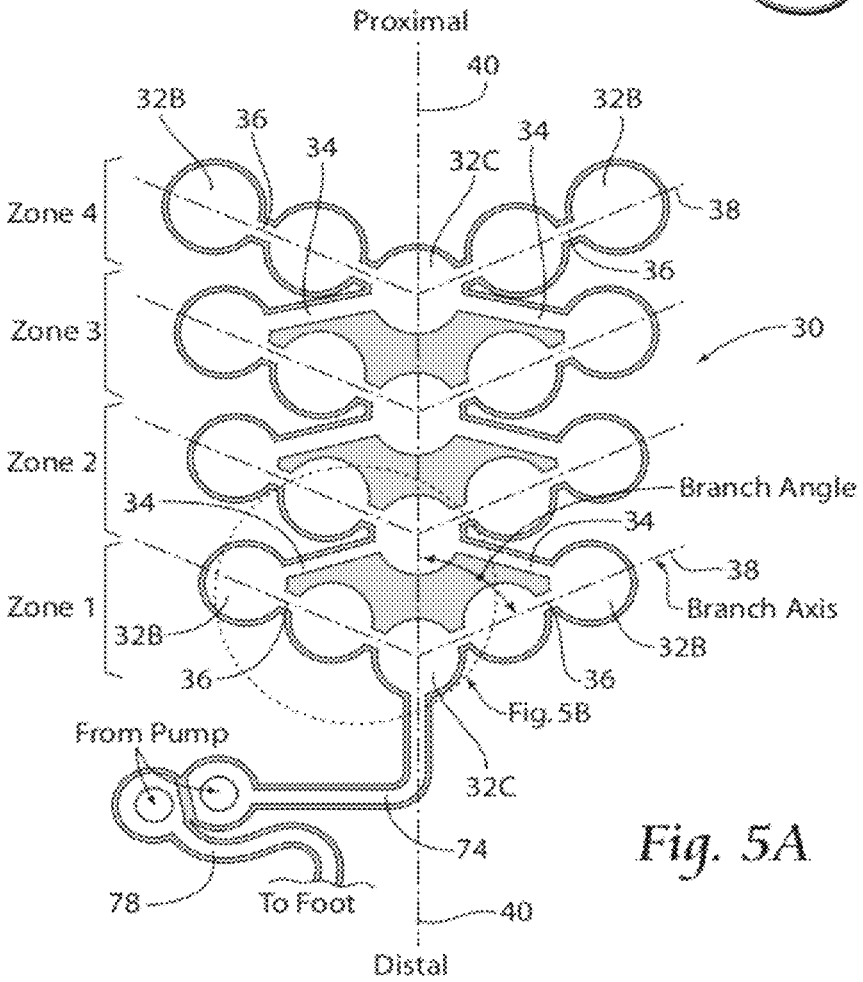
FIG. 5A is an enlarged plane view of the pneumatic network of the calf region of the pneumatic distribution garment shown in FIG. 4.
Figure 5B:
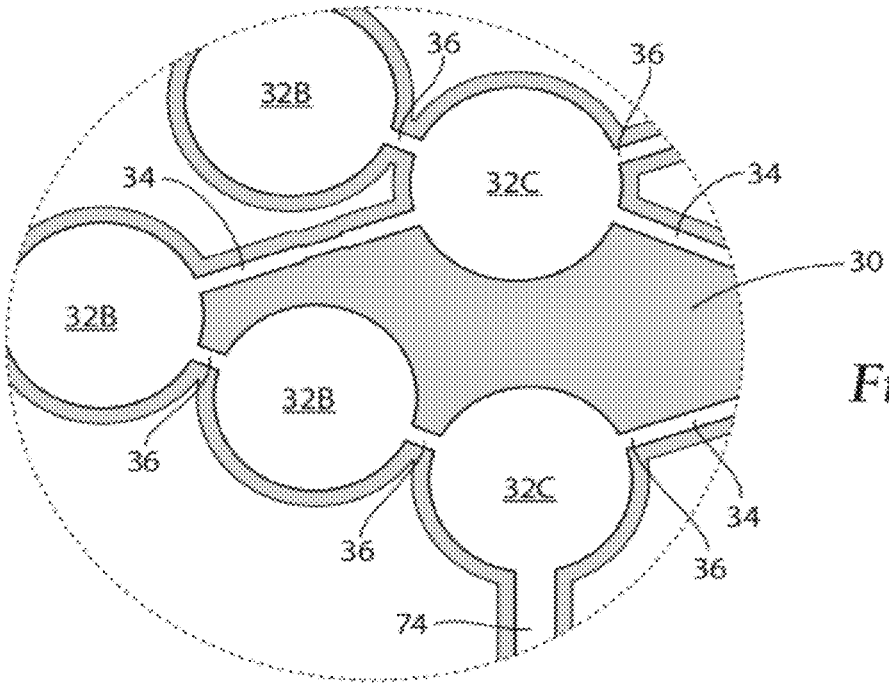
FIG. 5B is a further enlarged view of portion of the pneumatic network of the calf region of the pneumatic distribution garment shown in FIG. 5A.
Figure 6:
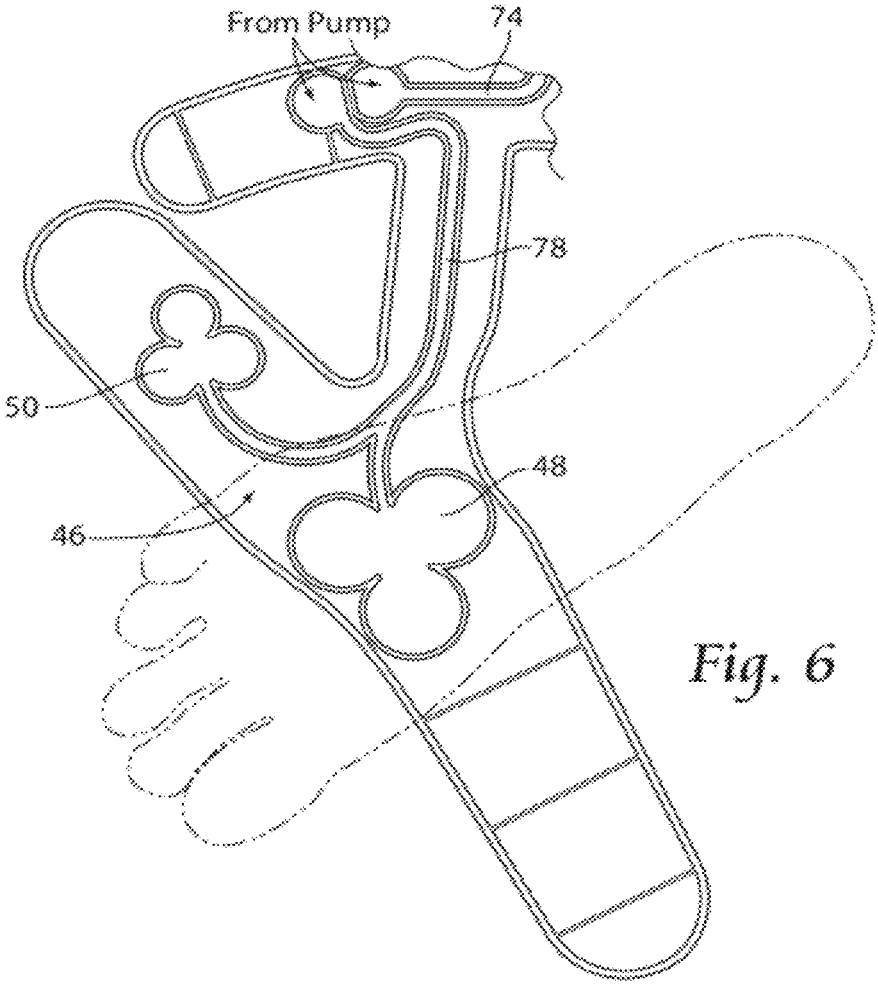
FIG. 6 is an enlarged plane view of the pneumatic network of the foot region of the pneumatic distribution garment shown in FIG. 4.
Figure 7:
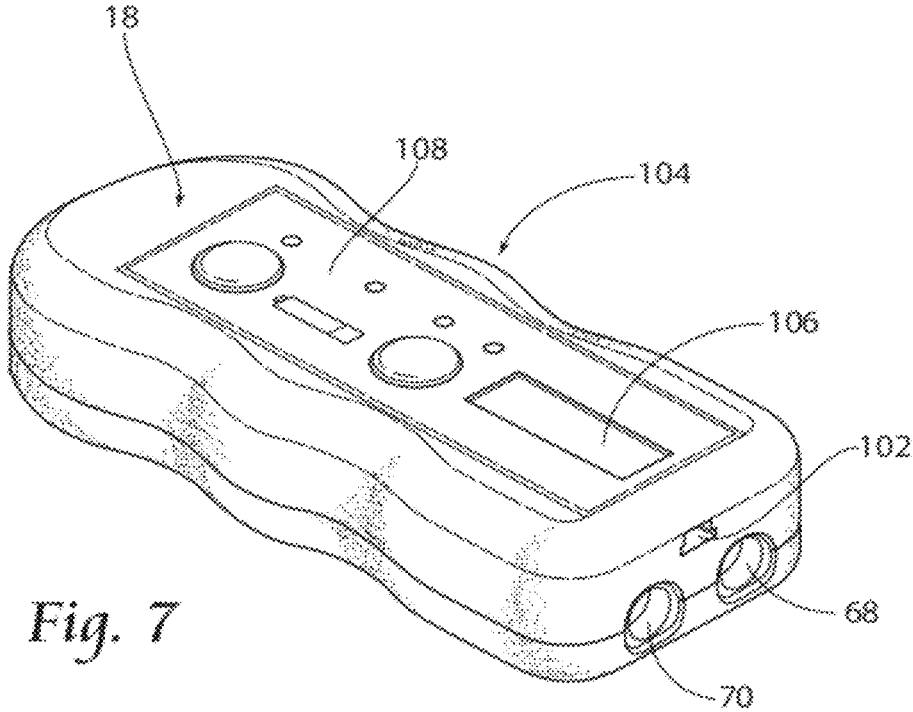
FIGS. 7 and 8A are, respectively, perspective top and bottom views of the control module shown in FIG. 4, detached from the pneumatic distribution garment.

The calf region 20 includes a pneumatic network 30 (see FIG. 5A) that, in use, communicates with the pneumatic fluid source 14 under the control of the controller 16. In the illustrated embodiment, the network is formed, e.g., by radiofrequency welds in the interior of the calf region 20. In use, as will be described in greater detail later, the controller 16 governs operation of the pneumatic fluid source 14 to provide pneumatic pressure to the network. The network 30 distributes the pneumatic pressure in a purposeful way, to provide progressive pneumatic compression of the veins and musculature in the calf region 20 that the network 30 overlies, advancing from distal limb to proximal limb.

In the calf region 20 (see FIG. 5A), a representative embodiment for the network 30 comprises two or more zones of pneumatic cells 32 that extend along the calf in a longitudinally stacked, caudal-to-cranial (distal-to-proximal) direction toward the heart. In this representative embodiment, the network 30 further includes channels 34 that establish fluid communication between adjacent zones, so that purposeful pneumatic compression applied to the most distal zone will progress to the next adjacent proximal zone, and so on in a caudal-to-cranial (distal-to-proximal) direction up the calf toward the heart.

In the representative embodiment for the calf region 20, each zone comprises a plurality of discrete pneumatic cells 32 purposely arranged in medial-to-lateral, left and right, radiating patterns toward the heart. The cells 32 within a given zone are linked in fluid communication by ports 36 formed between adjacent cells 32. In the illustrated embodiment, the ports 36 comprise separations in the walls of adjacent cells 32.

The cells 32 are sized and configured to receive pneumatic pressure and provide compression forces only to the tissue region that the network 30 overlies, to thereby increase the blood velocity within the deep venous network. Overlying only the posterior region of the limb, the cells 32 can be sized and configured to provide a network 30 having an overall reduced pneumatic load volume, without loss of applied compressive force. This compact, focused network 30, coupled with the tight "fit" of the garment 12 to the targeted tissue region, makes possible for the network to contain 1/10th the volume of air of the conventional full leg wrap sleeve designs.

The network 30 is sized and configured to be fitted to the musculature of a limb for distributing pneumatic fluid pressure to compress the musculature and augment blood flow velocity toward the heart. The network 30 comprises a total active fluid volume fitted to the musculature (AFV, expressed in ml) to apply an average compressive force to the musculature (ACF, expressed in mmHg). In a representative embodiment, the reduced pneumatic load volume of the network 30 can be expressed as a volume-to-compressive force ratio, comprising AFV/ACF being equal to or less than 8 ml/mmHg.

Reducing the volume of the pneumatic load of the network also makes possible the miniaturization of the components of the pneumatic fluid source 14 and controller 16, as will be described later. Miniaturization of these components provides a direct beneficial effect on the mobility of the patient, and ultimately on the efficacy of therapy.

In this arrangement, each zone includes a core cell 32C and radiating, divergent branch cells 32B that extend laterally right and left from the core cell 32C. The branch cells 32B radiate from the core cell 32C along at least two diverging branch axes 38, right and left, in caudal to cranial (distal-to-proximal) directions.

Within the network 30, the core cells 32C of each zone are generally mutually aligned along a common medial axis 40. In use, when properly fitted to the calf, the common medial axis 40 of the network 30 is desirably oriented in general longitudinal alignment with the longitudinal axis of the limb.

In each zone, the branch cells 32B extend laterally from the respective core cell 32C along lateral right and left branch axes 38, which diverge from the medial axis 40 by a branch angle. The branch angle is selected to be less than perpendicular (i.e., less than 90°) relative to the medial axis 40. The branch angle is also selected so that, when the garment 12 is properly fitted to the limb, the branch angle is not substantially aligned with the longitudinal axis of the limb itself. Thus, the branch angle is selected to provide both a lateral distribution of branch cells 32B relative to the longitudinal axis of the limb and also a proximal (toward the heart) advancement of branch cells 32B relative to the respective core cell 32C. That is, in each zone, the branch cells 32B will progressively distribute pneumatic pressure both in a lateral direction from the core cell 32C as well as advance the pneumatic pressure in a proximal direction (toward the heart) from the core cell 32C.

The channels 34 between the zones of the network 30 replicate this lateral and proximal advancement from one zone to the next adjacent zone. The channels 34 provide communication between the outermost right and left branch cells 32B in each zone to the core cell 32C of the next adjacent zone in a proximal direction. The channels 34 are sized and configured to be of a smaller dimension than the ports 36 between the cells 32.

The selection of the branch angle takes into account the local musculature and vascular anatomy of the region that the garment 12 overlies. The morphology of the local musculature and vascular structures can be generally understood by medical professionals using textbooks of human anatomy along with their knowledge of the site, the treatment objectives, and aided by prior analysis of the morphology of the targeted treatment region using, for example, plain film x-ray, fluoroscopic x-ray, or MRI or CT scanning.

A representative branch angle for a calf region 20 is from about 15° to about 85° measured from the longitudinal axis of the limb. This angle more closely follows the musculature of the peripheral limbs, in which the limbs are tapered from the more proximal regions to the more distal regions. A network of core cells with a branching angle of about 15° to about 85° measured from the longitudinal axis of the limb, when wrapped partially around the limb tissue in contact with the musculature of the posterior lower leg (i.e., the calf), makes possible progressive compression that complements the native limb taper.

The network 30 can include variations in configuration and design. For example, the channel 34 between the most distal zone (closest to the foot) (designated Zone 1) and the next proximal zone (designated Zone 2) may vary in cross sectional inner dimension to allow for a phase delay, so that Zone 2 is not completely pressurized before Zone 1 has completely pressurized. Complete pressurization of Zone 1 is not required before subsequent zones begin to pressurize. However, complete pressurization of the most distal Zone 1 (farthest from the heart) is desirably before complete pressurization of the most proximal zone (closest to the heart) (designated Zone 4). This sequence prevents the compression applied by the most proximal zone from hindering the compression applied to the venous network by the more distal zones.

As another example, the cells 32 may themselves vary in size and dimension from the distal to the proximal zones. The cell 32 may be circular in shape. Still, alternative embodiments include oval, hexagonal, octagonal, rectangular, and/or conical geometries, or combinations thereof.

2. The Foot Region

The venous network of the foot comprises vessels that are in general much smaller than the vessels in the venous network of the calf. The smaller vessels in the foot will reduce in inner diameter to aid venous blood flow either through direct compression or via extension of bones within the foot. The size and configuration of the foot region 22 of the garment 12 takes into account these two modes of inner diameter reduction, by the inclusion of pneumatic cell zones on both the top and bottom of the foot.

More particularly, in a representative embodiment, the foot region 22 is sized and configured to be securely wrapped about both the plantar (bottom sole) and dorsal (top) surfaces of the mid-foot region.

Appendages 42 and releasable fasteners 44 incorporated on the foot region 22, such as, e.g., snaps, magnets, buckles, straps, VELCRO® fabric, and the like, couple together over the dorsal surface of the foot, allowing the individual to adjust the fit and form of the foot region 22 about the foot. When properly positioned about the foot, the foot region 22 intimately overlies, e.g., the plantar venous network and the plantar digital veins that communicate with the dorsal digital veins, as well as over the dorsal metatarsal veins, which join to form the dorsal venous arch.

As previously described with reference to the calf region 20, the appendages 42 and fasteners 44 for the foot region 22 are also sized and configured to provide a desired "fit" of the garment 12 to the foot. The proper fit provides consistent and direct compression to the large tissue mass of the sole and top of the foot. The appendages 42 and fasteners 44 desirably pull the pneumatic network of the garment 12 (as will be described) very close to the tissue without pain or discomfort. The size and configuration of the appendages 42 and fasteners 44 help to focus contact of the pneumatic network to the targeted foot tissue. The size and configuration of the appendages 42 and fasteners 44 allow for an open feel for the garment 12, providing breathability for the contacted tissue region, but also conformity of the garment 12 to various anatomical shapes.

The foot region 22, like the calf region 20, includes a pneumatic network 46 that, in use, communicates with the pneumatic fluid source 14. The calf region 20 and the foot region 22 for a given garment 12 communicate with the same pneumatic fluid source 14. A single controller 16 thereby governs the fluid communication with the two regions.

In the illustrated embodiment, as for the calf region 20, the network 46 of the foot region 22 is formed, e.g., by radiofrequency welds in the interior of the calf region 20. In use, as will be described in greater detail later, the controller 16 governs operation of the pneumatic fluid source 14 to provide pneumatic pressure to the network 46. The network 46 distributes the pneumatic pressure in a purposeful way, to provide progressive pneumatic compression of the veins and musculature in the foot that the network 46 overlies.

In the foot region 22, a representative embodiment for the network 46 comprises a plantar (bottom foot) zone 48 comprising a first pneumatic cell pattern. The network 46 further comprises a dorsal (top foot) zone 50 comprising a second pneumatic cell pattern. In this arrangement, the network 46 further includes a channel 52 communicating with the pneumatic fluid source 14 with branches that communicate, respectively, with the plantar zone 48 and the dorsal zone 50. As is the case for the network of the calf region 20, the first and second pneumatic cell patterns 48 and 50 are sized and configured to receive pneumatic pressure and provide compression forces to the tissue region that the network 46 overlies, to thereby increase the blood velocity within the venous network of the foot. The size and configuration of the first and second pneumatic cell patterns 48 and 50 are desirably selected to provide a network 46 having an overall reduced pneumatic load volume, without loss of applied compressive force.

The network 46 is sized and configured to be fitted to the musculature of an appendage for distributing pneumatic fluid pressure to compress the musculature and augment blood flow velocity toward the heart. The network 46 comprises a total active fluid volume fitted to the musculature (AFV, expressed in ml) to apply an average compressive force to the musculature (ACF, expressed in mmHg). In a representative embodiment, the reduced pneumatic load volume of the network 46 can be expressed as a volume-to-compressive force ratio, comprising AFV/ACF being equal to or less than 4 ml/mmHg.

As before explained, reducing the volume of the pneumatic load of the network 46 makes possible the miniaturization of the components of the pneumatic fluid source 14 and controller 16, as will be described later. Miniaturization of these components provides a direct beneficial effect on the mobility of the patient, and ultimately on the efficacy of therapy.

In the illustrated embodiment, the first pneumatic cell pattern of the plantar zone 48 is sized and configured to overlie the sole of the foot in a region that closer to the toes than to the heel. The second pneumatic cell pattern of the dorsal zone 50 is sized and configured to overlie a corresponding dorsal region of the foot closer to the toes than to the ankle.

In this arrangement, the first pneumatic cell pattern 48 and the second pneumatic cell pattern 50 each take the shape of center region having a plurality of enlarged cell nodes that arch radially from the center region, forming in a curvilinear, clover-like design. Taking into account the relative morphologies of the sole of the foot and the top of the foot, the first pneumatic cell pattern 48 for the sole of the foot covers a larger area than the second pneumatic cell pattern 50 for the top of the foot. The plantar zone 48 is orientated such that the larger first pneumatic cell pattern focuses compression on the sole of the foot, with most of the pressure concentrated toward the front of the foot. The dorsal zone 50 is oriented such that the compressive power of the smaller second pneumatic cell pattern is focused mid-foot, to help extend the bones within the foot. These complementary top and bottom cell patterns 48 and 50 spread relatively small fluid volumes over a relatively large surface area, essentially spanning the entire top and bottom of the mid-foot.

The essentially simultaneous conveyance of pressurized fluid into these zones 48 and 50 on the top and bottom of the mid-foot applies compression rapidly and uniformly in tandem throughout the sole of the foot and the top of the foot, with a concentration of the pressure on the front of the foot. The dorsal (top foot) zone 50, in tandem with the plantar (bottom foot zone) 48, compress against the vascular as well as the bones of the mid-foot to extend the foot, thereby reducing the diameter of the vasculature and augmenting blood flow. The rapid and uniform compression caused by the plantar (bottom foot) zone 48 and the dorsal (top foot) zone 50 in this region of the foot provides an emptying effect to the network of veins within the foot, which emulates venous drainage of the foot during walking.

C. The Pneumatic Fluid Source

The pneumatic fluid source 14 is carried within the control module 18 that is supported wholly on the pneumatic fluid distribution garment 12. As previously described, the components of the pneumatic fluid distribution garment 12 are sized and configured to provide an overall reduced pneumatic load volume, which makes possible a miniaturization of the pneumatic fluid source 14 and other components carried within the control module 18. The ability to support all mechanical and electrical components wholly on the pneumatic fluid distribution garment 12 makes possible a mobile, user-friendly therapy.

FIGS. 9 and 10 reveal the mechanical and electrical components that arrayed within the control module 18. The pneumatic fluid source 14 comprises a pressurized air pump 54, a manifold 56 that communicates with the pressurized air pump 54, and a valve assembly 58 that, under the control of the controller 16, directs pressurized air from the pressurized air pump 54 through the manifold 56.

The pressurized air pump 54 can comprise, e.g., a miniaturized diaphragm pump 54 driven by a brushless dual bearing motor that operates on 12 VDC. A representative pump 54 that is commercially available is a Hargraves E182-11-120 CTS diaphragm pump. This pump provides continuous air pressure at 16.5 PSIG (maximum 17.0 PSIG). The output of the pressurized air pump 54 is conveyed by an input line 60 to the manifold 56.

Figure 11:
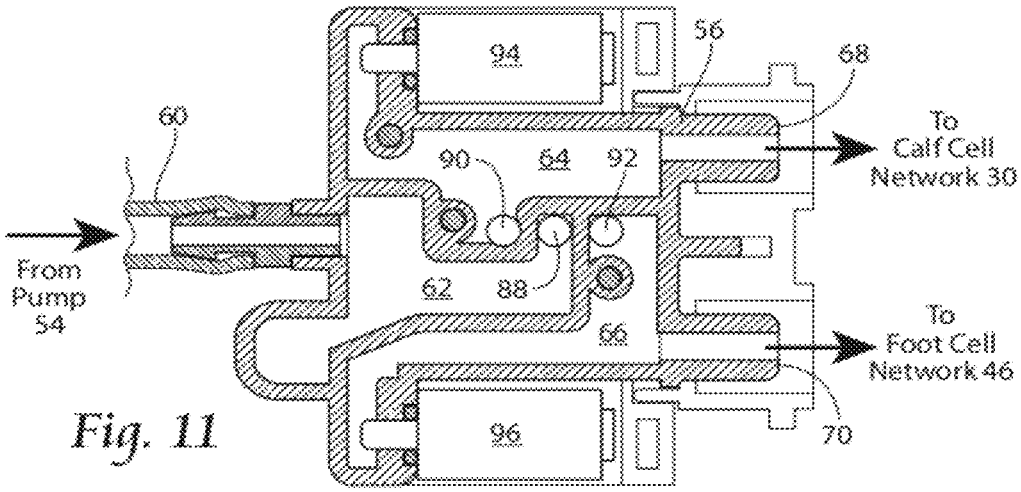
FIG. 11 is a top section view of the manifold that forms a part of the pneumatic fluid source housed within the control module.

FIG. 11 shows the interior of the manifold 56. The interior of the manifold 56 is compartmentalized into a pilot air chamber 62, a calf network air chamber 64, and a foot network air chamber 66. The manifold 56 can be ultrasonically welded to individually seal the pilot air chamber 62, the calf network air chamber 64, and the foot network air chamber 66 from each other.

The manifold 56 includes two outlets, which separately communicate, respectively, with the calf and foot networks in the pneumatic fluid distribution garment 12. The manifold outlets will be identified as the calf network outlet 68 and the foot network outlet 70. The calf network outlet 68 communicates with the calf network air chamber 64. The foot network outlet 70 communicates with the foot network air chamber 66. The outlets 68 and 70 are accessible through openings formed in the front of the control module 18.

The pneumatic fluid distribution garment 12 includes a calf network coupler 72, which communicates with an inlet passage 74 to the calf network 30, and a foot network coupler 76, which separately communicates with an inlet passage 78 to the foot network 46. The couplers 72 and 76 are sized and configured to releasably snap-fit with the respective manifold outlets 68 and 70. The mating establishes fluid communication between the calf and foot network chambers 64 and 66 within the manifold 56 and their respective air distribution networks 30 and 46 formed in the garment 12. The mating also releasably attaches the front of the control module 18 to the garment 12.

Figure 4:
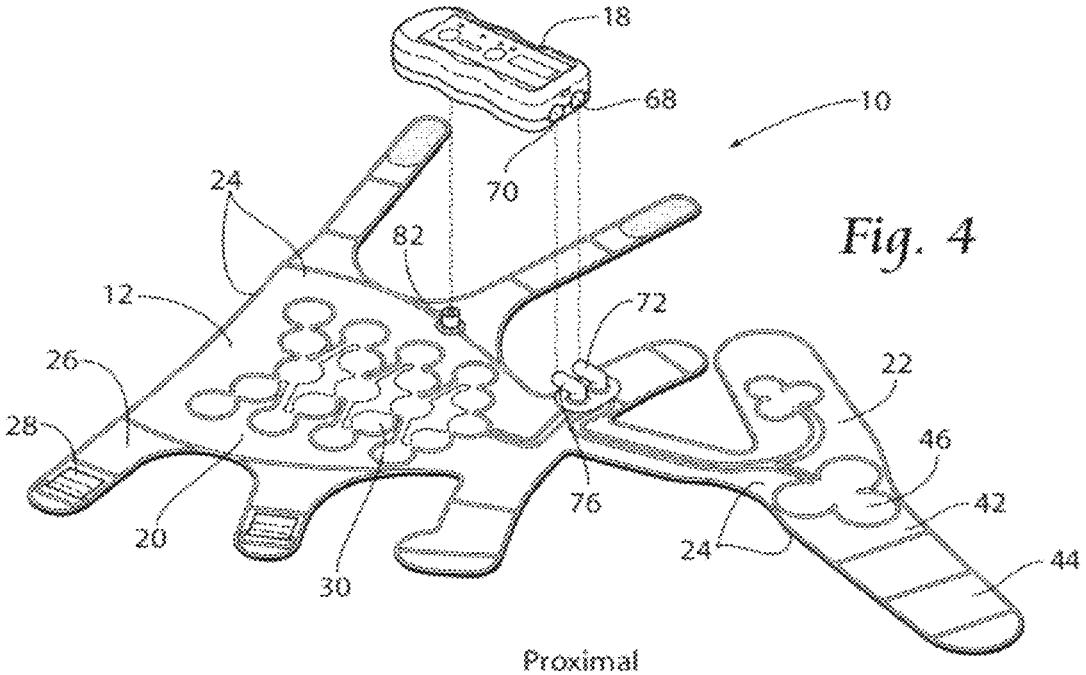
FIG. 4 is an exploded perspective view of the system shown in FIG. 2C, with the control module of the system released from the pneumatic distribution garment of the system.
Figure 8A:
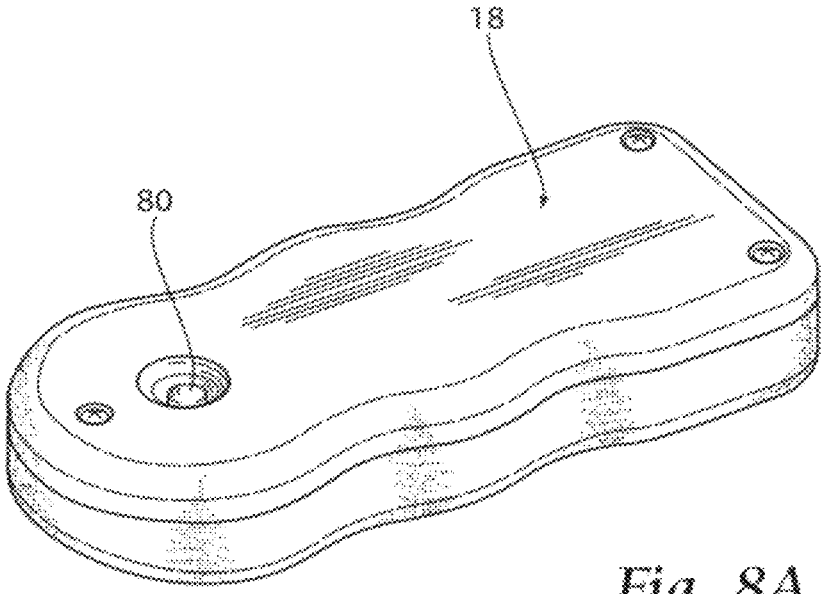

In the embodiment shown in FIG. 8A, the underside at the rear of the control module 18 includes a female fastener 80, which releasably snap-fits to a male fastener 82 on the garment 12, to releasably attach the rear of the control module 18 to the garment 12 (as also shown in FIG. 4).

Figure 8B:
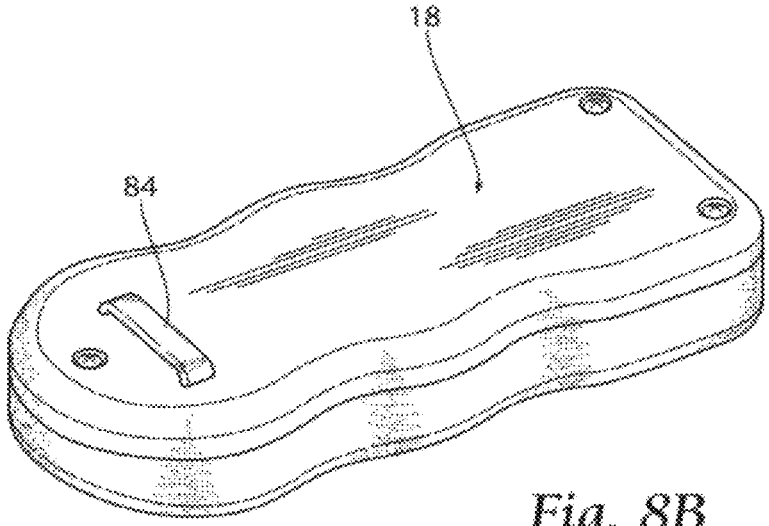
FIG. 8B is a perspective bottom view of an alternative embodiment of a control module, having a form of attachment that is different than that shown in FIG. 4.
Figure 8C:
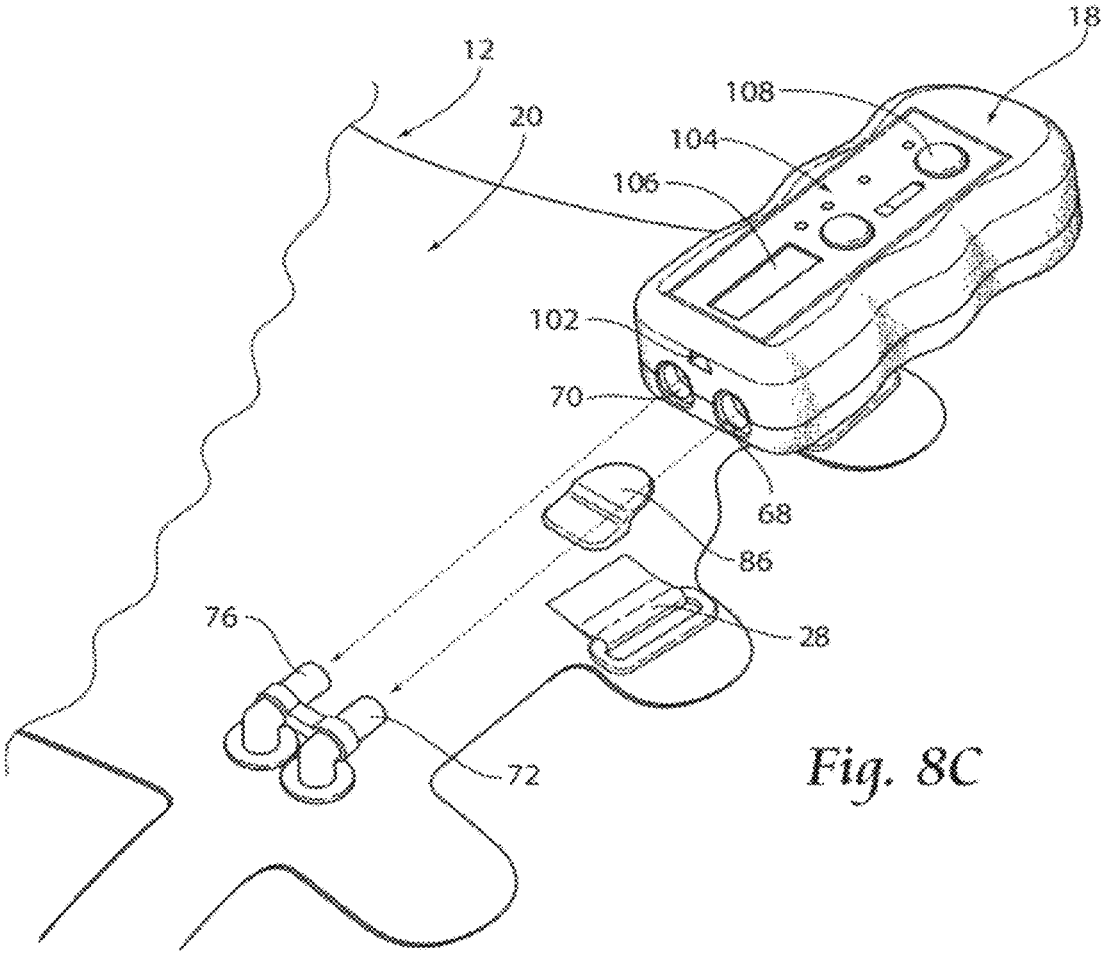
FIG. 8C is a perspective top view of the control module shown on FIG. 8C, showing its different form of attachment to the pneumatic distribution garment.

In the embodiment shown in FIG. 8B, the underside at the rear of the control module 18 includes a female clip 84. As FIG. 8C shows, a male flange 86 attached to the garment 12 inserts into the female clip 84 on the control module 18 as the couplers 72 and 76 on the garment 12 releasably snap-fit in a sliding motion with the respective manifold outlets 68 and 70.

Three valve ports in the manifold 56 (see FIG. 11) establish communication between the pilot air chamber 62 and either the calf network air chamber 64 or the foot network air chamber 66. These ports will be identified as the pilot air port 88 (communicating with the pilot air chamber 62), the calf network air port 90 (communicating with the calf network air chamber 64), and the foot network air port 92 (communicating with the foot network air chamber 66). O-ring gaskets can be provided at the connection of the valve ports with the valve assembly 58.

Under control of the controller 16 (as will be described later), the valve assembly 58 affects the opening and closing of these valve ports 88, 90, 92 in a selected fashion to carry out of the objectives of the therapy session. The valve assembly 58 is operable in two valve states, one in which the valve assembly 58 is energized (Valve State 1) and the other in which the valve assembly 58 is de-energized (Valve State 2).

When the valve assembly 58 is energized (Valve State 1) (see FIG. 12A), the calf network air port 90 is closed, and the foot network air port 92 and the pilot air port 88 are opened.

When the valve assembly 58 is de-energized (Valve State 2) (see FIG. 12B), the calf network air port 90 and the pilot air port 88 are opened, and the foot network air port 92 is closed.

When pressurization of the foot region 22 of the garment 12 is desired (as will be described in greater detail later), the controller 16 turns the pump 54 on and energizes the valve assembly 58 to establish the first valve state (see FIG. 12A) (also called the foot compression state). Pressurized air from the pump 54 is conveyed through the pilot air chamber 62 into the foot network air chamber 66. No pressurized air from the pump 54 is conveyed through the pilot air chamber 62 into the calf network air chamber 64 (because the calf network air port 90 is closed).

When pressurization of the calf region 20 of the garment 12 is desired (as will be described in greater detail later), the controller 16 turns the pump 54 on (if necessary) and de-energizes the valve assembly 58 to establish the second valve state (see FIGS. 12B and C) (also called the calf compression state). Pressurized air from the pump 54 is conveyed through the pilot air chamber 62 into the calf network air chamber 64. No pressurized air from the pump 54 is conveyed through the pilot air chamber 62 into the foot network air chamber 66 (because the foot network air port 92 is closed).

The valve assembly 58 can comprise, e.g., a conventional 3-Way solenoid valve, such as a Parker/Hargraves Magnum Series 3-Way Valve.

The manifold 56 (see FIG. 11) also includes two vent valves 94 and 96. One vent valve 94 communicates with the calf network air chamber 64 of the manifold 56, and the other vent valve 96 communicates with the foot network air chamber 66 of the manifold 56. The vent valves 94 and 96 are normally open valves (when de-energized), and are closed under the control of the controller 16 (when energized). The vent valves 94 and 96 can each comprise a conventional two way solenoid valve, such as a Parker PND Solenoid Valve. When closed, the vent valves 94 and 96 maintain pressurized air conditions within the respective chamber. When opened, pressurized air residing within the chamber is vented to atmosphere.

By turning the pump 54 off, opening the vent valves 94 and 96 (by de-energizing them), and also de-energizing the valve assembly 58 to establish the second valve state (see FIG. 12D), pressurized air residing in both the calf network air chamber 64 and the foot network air chamber 66 are vented through the open vent valves 94 and 96 and pump 54 to atmosphere. Pressurized air residing in the calf and foot networks 30 and 46 of the garment 12 are likewise vented by the vent valves 94 and 96 and (for the calf network 30) pump 54 directly to atmosphere.

D. The Controller

The controller 16 resides on a control printed circuit board 98 in the control module 18.

The controller 16 and the components of the pneumatic fluid source 14 desirably receive power from an on-board power supply 100. In a representative embodiment, the power supply 100 can comprise a rechargeable lithium ion battery, such as e.g., a 2600 mAh Lithium Ion Battery. The controller 16 electrically couples the power supply 100 to the pneumatic pump 54, the valve assembly 58, and the vent valves 94 and 96, by use of hard wiring and/or integrated circuit connections.

The controller 16 also desirable includes an on-board battery charging circuit. To recharge the battery, the user detaches the control module 18 from the garment 12 (as shown in FIG. 4) and couples a conventional USB port 102 on the control module 18 to an AC power cable or a charging station that couples to an AC power outlet. After charging, the user detaches the control module 18 from the power source and reattaches the control module 18 to the garment 12 for use. Alternatively, a special-purpose charger can be provided designed to accept two control modules 18 for simultaneous charging. The charger, e.g., can be sized and configured to mount vertically on a wall socket, accepting standard wall socket power of 115 VAC and outputs 5 V at 500 mA to each control module 18.

The controller 16 desirably includes an interactive user/clinician interface 104. The interface 104 informs the user/clinician of relevant operational status conditions, and also desirably allows the user/clinician to enter a defined list of operational inputs affecting performance of the system 10. In a representative embodiment, the user/clinician interface 104 includes, e.g., an LCD screen 106 for visually displaying information to the user/clinician, a membrane switch overlay 108 with buttons and LED's to receive input from the user/clinician and/or provide control and status information to the user/clinician, and an audible output device to alert the user/clinician to important status or operational conditions. Representative input include, e.g., power on, power off, and therapy session parameters that can be changed by the user/clinician.

In a representative embodiment, sensed operating conditions are also communicated to the controller 16 for operational monitoring purposes as well as output to the user/clinician through the user/clinician interface. In a representative embodiment, the sensed conditions include, e.g., the internal pressure within the manifold 56 as sensed by a pressure transducer 110, which communicates with the pilot air chamber 62 in the manifold 56. The sensed conditions can also include, e.g., the battery charge condition.

The controller 16 also includes a microprocessor 112. The microprocessor 112 can include embedded code and/or can be programmed by a clinician to express pre-programmed rules or algorithms. The pre-programmed rules or algorithms generate the control signals and their sequence to govern the operation of the pneumatic pump 54, the valve assembly 58, and the vent valves 94 and 96 to carry out the desired objectives of a given therapy session, as will be described in greater detail later.

The microprocessor 112 can also include memory to register the use of the system 10 by the individual user. The memory can, e.g., register the number of treatment sessions conducted, the time and duration of each session, the pressure conditions sensed during the treatment sessions, and other clinical data of relevance to the caregiver to monitor and supervise an individual's compliance to a prescribed protocol. The microprocessor 112 can include a function for downloading on demand the registered data, e.g., through the USB port 102, to an external device for storage and/or review by a caregiver.

In a representative embodiment, the size and configuration of the controller 16 makes possible a durable, compact, and portable device; e.g., measuring 6×2.5×1.3 inches, and weighing, with on-board battery, less than 9 ounces. By virtue of its construct, the controller 16 need not require manual internal circuit adjustments, and can be reliably fabricated using automated circuit board assembly equipment and methods. In this arrangement, the controller 16 comprises a printed circuit board assembly (PCB) 98 of components to manage power, pneumatics, user inputs and outputs, with an LCD screen to display pertinent information related to the function of the system 10.

E. Kits

Figure 14:
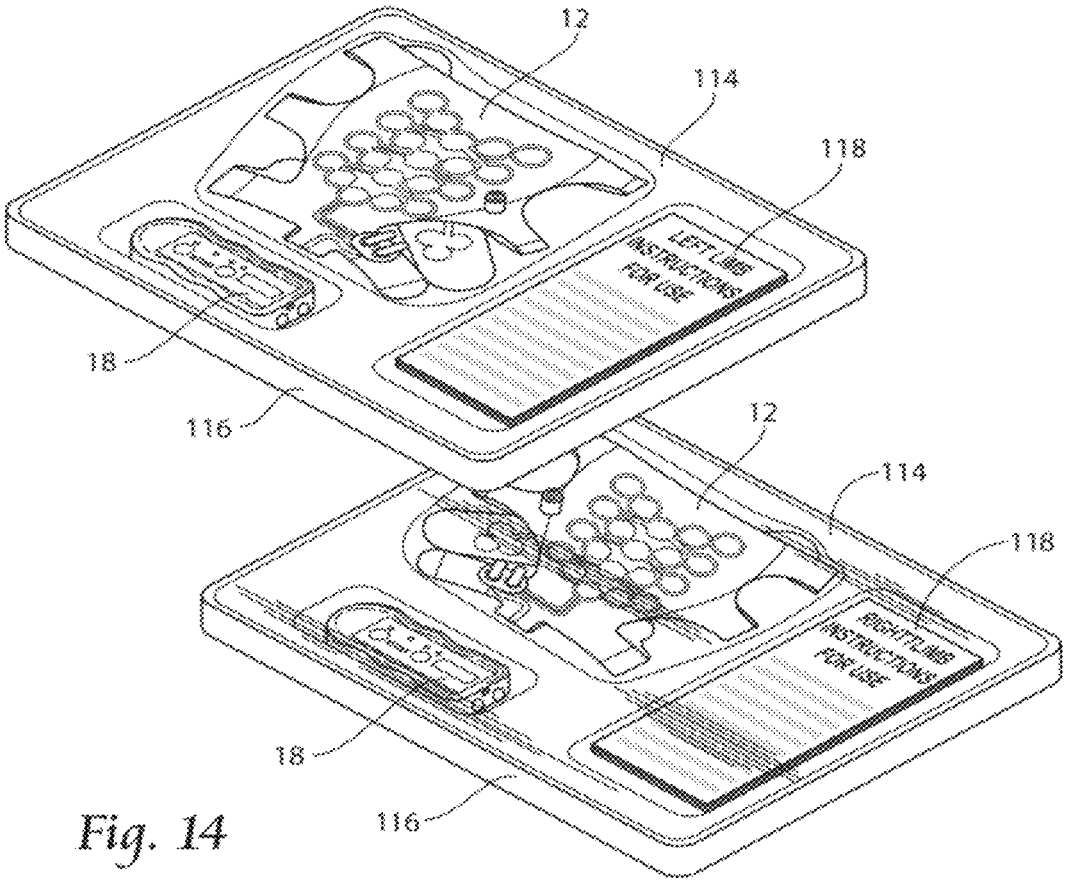
FIG. 14 is a perspective view of kits in which the system shown in FIGS. 2A and 3A are packaged for use.

The system 10 and its components can be consolidated for use in one or more functional kits 114 (see FIG. 14). The kits 114 can take various forms. In a representative embodiment, a kit 114 comprises an aseptic wrapped assembly, which includes an interior tray 116 made, e.g., from die cut cardboard, plastic sheet, or thermo-formed plastic material, which holds the contents during shipping and prior to use. The contents for the kit 114 can include, e.g., a pneumatic fluid distribution garment 12 (left or right limb or both), a dedicated pneumatic fluid source 14 and controller 16 packaged in a control module 18 for each garment 12 provided, a battery charging station, and instructions 118 for the user instruction how the contents of the kit 114 should be used to carry out the desired therapeutic objectives. These instructions 118 for use comprise instruction intended to for the individual user, to direct an individual user e.g., how to attach the garment(s) 12 to their limb(s); how to attach and detach the control module 18 to and from the garment 12; how to turn power on and off to the control module 18; how to interact with the user interface 104 on the control module 18; how to enter inputs through the user interface 104; and how to charge the control module 18. These instructions 118 will be found in the kit 114. Other instructions for use may not be found in the kits 114 for a user, as these comprise instructions intended to be incorporated into the pre-programmed rules or algorithms embedded in the microprocessor 112 of the controller 16, which work in the background without user knowledge or intervention. Details of representative instructions for use will be described later.

The instructions 118 can, of course vary. The instructions 118 typically will be physically present in a given kit 114, but the instructions can also be supplied separately. The instructions 118 can be embodied in separate instruction manuals, or in video or audio tapes, CD's, and DVD's. The instructions 118 for use can also be available through an internet web page.

An external programming instrument can be provided, or, alternatively, can comprise a general purpose personal computer or personal digital device fitted with a suitable custom program and a suitable cable or interface box, to allow a clinician to alter or customize the pre-programmed rules or algorithms residing in the microprocessor 112, when desired.

II. Use of the System

Representative instructions 118 for using a system 10 of the type just described, and the functioning of the controller 16 to govern operation of the components during a typical treatment session, will now be described.

The treatment session described will entail operating the system 10 to increase the velocity of blood in the peripheral venous network of the lower limb of an individual (foot and/or calf); for example, as a prophylaxis for the prevention of deep vein thrombosis. The treatment session can be conducted in a hospital setting, or at a rehabilitation center, or at home.

The instructions 118 for use contained in the kit 114 instruct an individual to assure that the battery of the control module 18 is fully charged prior to use, and further instructs the individual how to charge the battery if the battery is not fully charged. The instructions 118 for use contained in the kit 114 instruct the individual how to attach the control module(s) 18 to the garment(s) 12.

The instructions 118 for use contained in the kit 114 instruct an individual to select using the user interface 104 of the control module 18, either a "full treatment mode" or "a mobility mode."

In the full treatment mode, both calf and foot regions 20 and 22 of the garment 12 are worn, and pressurized air is directed in sequence first into the foot region 22, then the calf region 20, followed by a venting of pressure and a delay, and the sequence is repeated during a prescribed full treatment cycle time.

In the mobility mode, only the calf region 20 of the garment 12 is worn, allowing the individual to walk unimpeded while pressurized air is directed in sequence to the calf region 20, followed by a venting of pressure and a delay, and a repeat of the calf-only sequence a prescribed treatment cycle time.

A. Full Treatment Mode

If the full treatment mode is selected, the instruction 118 for use direct the individual how to attach the garment(s) 12 found in the kit 114 to the proper limb or limbs. The importance of the "fit" of the garment 12 to the calf and foot has been previously described. The instructions 118 for use instruct the individual how to turn on the control module 18 and perform the preliminary steps for initiating a full treatment mode session.

Once the individual selects the full treatment mode, and the full treatment session begins, direct involvement of the individual ceases, and the instructions 118 for use embedded in the controller 16 are carried out by the controller 16, without further intervention of the individual.

Figure 12A:
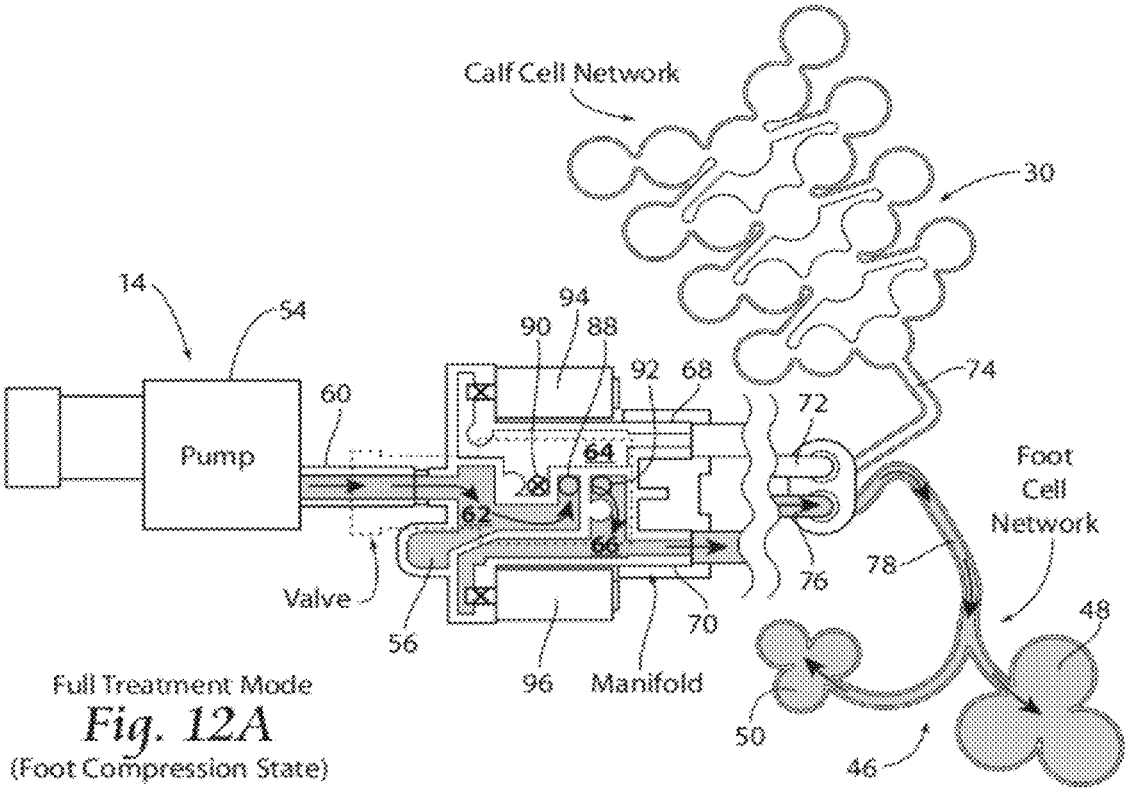
FIG. 12A is a diagrammatic view of the operation of the pneumatic fluid source in a full treatment mode, governed by the controller, during the foot compression state, during which compressed pneumatic fluid is conveyed into the foot region of the pneumatic distribution garment.

In a representative full treatment mode session, the controller 16 activates the pneumatic pump 54, commands the vent valves 94 and 96 to close (by energizing the vent valves 94 and 96), and energizes the valve assembly 58 to establish the first valve state (see FIG. 12A). The controller 16 monitors pressure sensed by the transducer 110 in the pilot air chamber 62 to assure that the pump 54 is operational and supplying pressurized air into the pilot air chamber 62.

Pressurized air is directed through the pilot air chamber 62 into the foot network air chamber 66, through the foot network air chamber outlet 70, and into the network 46 of the foot region 22. The controller 16 maintains this condition for a prescribed time period (e.g., about 1 to 3 seconds) to allow pressurized air to enter the network 46 of the foot region 22 and simultaneously compress tissue on the sole and top of the foot to affect a proximal flow of blood from the foot.

As before described, the essentially simultaneous conveyance of pressurized fluid into the zones 48 and 50 on the top and bottom of the mid-foot applies compression rapidly and uniformly in tandem throughout the sole of the foot and the top of the foot, with a concentration of the pressure on the front of the foot. The dorsal (top foot) zone 50, in tandem with the plantar (bottom foot zone) 48, compress against the vascular as well as the bones of the mid-foot to extend the foot, thereby reducing the diameter of the vasculature and augmenting blood flow. The rapid and uniform compression caused by the plantar (bottom foot) zone 48 and the dorsal (top foot) zone 50 in this region of the foot provides an emptying effect to the network of veins within the foot, which emulates venous drainage of the foot during walking.

Figure 12B:
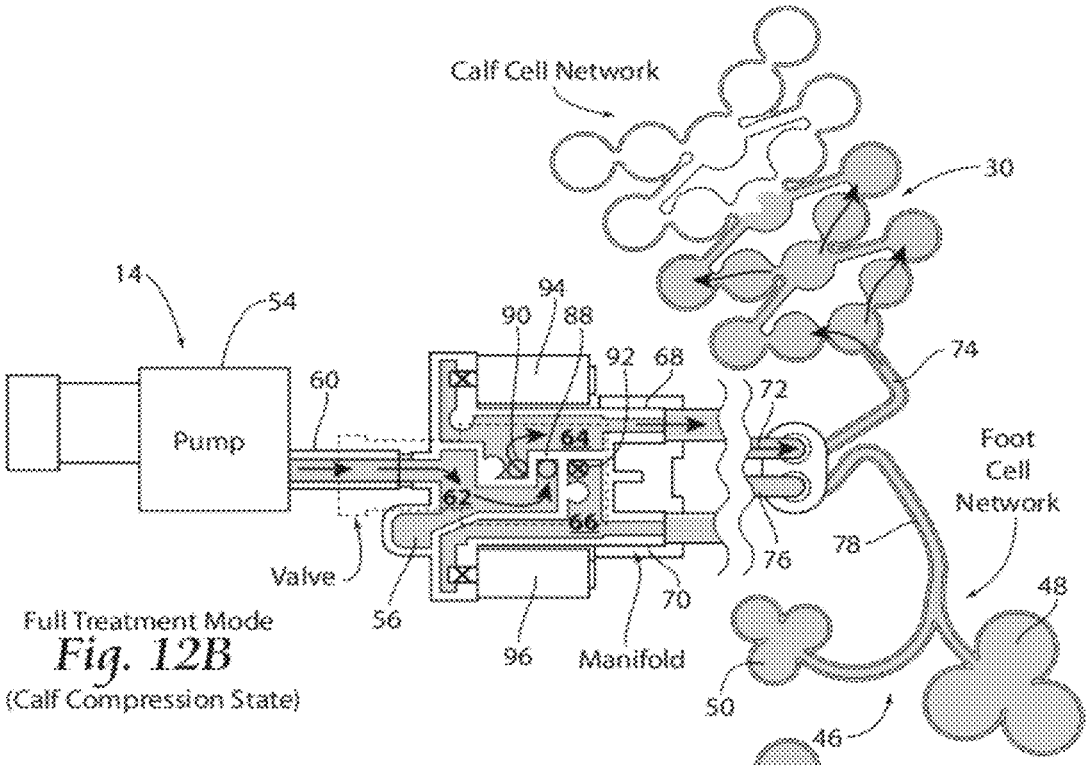
FIGS. 12B and 12C are diagrammatic views of the operation of the pneumatic fluid source in a full treatment mode, governed by the controller, during the calf compression state, during which compressed pneumatic fluid is conveyed into the calf region of the pneumatic distribution garment.
Figure 12C:
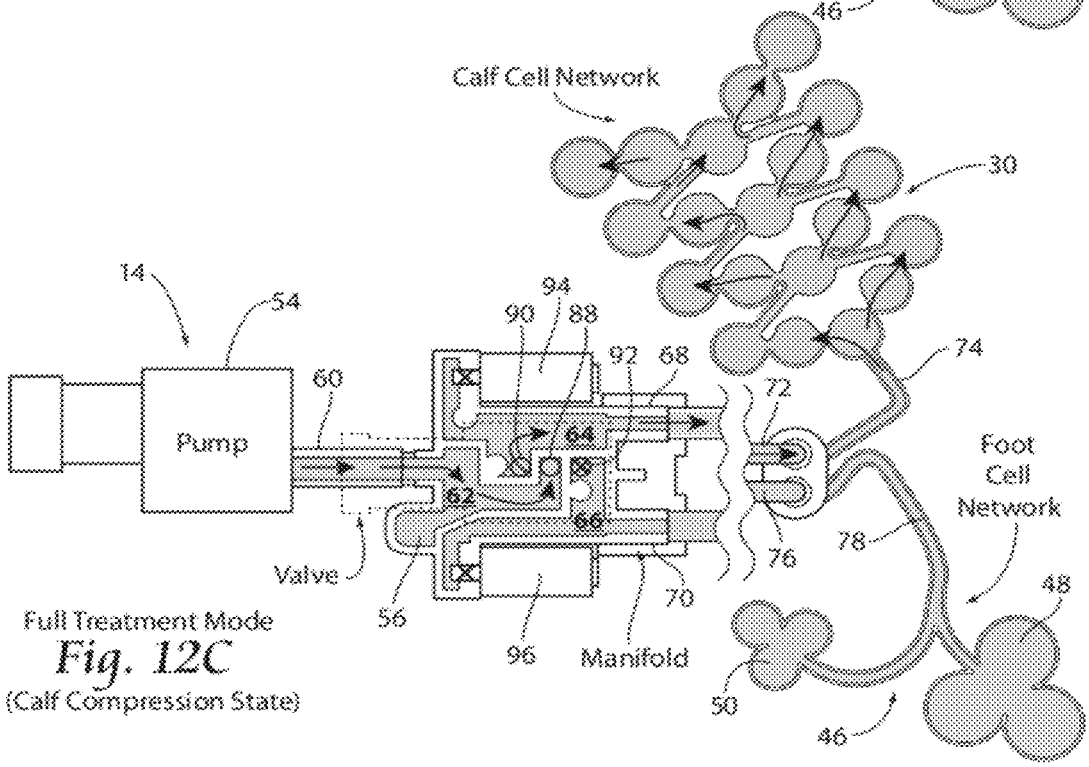

At the end of the prescribed time period, the controller 16 de-energizes the valve assembly 58 to establish the second valve state (see FIG. 12B). The foot network air port 92 closes, which holds pressure in the network of the foot region 22. Meanwhile, pressurized air is directed through the pilot air chamber 62 into the calf network air chamber 64, through the calf air chamber outlet 68, and into the network 30 of the calf region 20. The controller 16 maintains this condition for a prescribed time period (e.g., about 4 to 5 seconds) to allow pressurized air to advance laterally and proximally in the network 30 of the calf region 20 (see FIGS. 12B and 12C).

As before described, in each zone of the network 30, the branch cells 32B progressively distribute pneumatic pressure both in a lateral direction from the core cell 32C, as well as advance the pneumatic pressure in a proximal direction (toward the heart) from the core cell 32C. The channels 34 between the zones of the network 30 replicate this lateral and proximal advancement from one zone to the next adjacent zone. The network of core cells 32C with branching cells 32B at a branching angle of about 15° to about 85° measured from the longitudinal axis of the limb, when wrapped partially around the limb tissue in contact with the musculature of the posterior lower leg (i.e., the calf), apply progressive compression that complements the native limb taper.

Figure 12D:
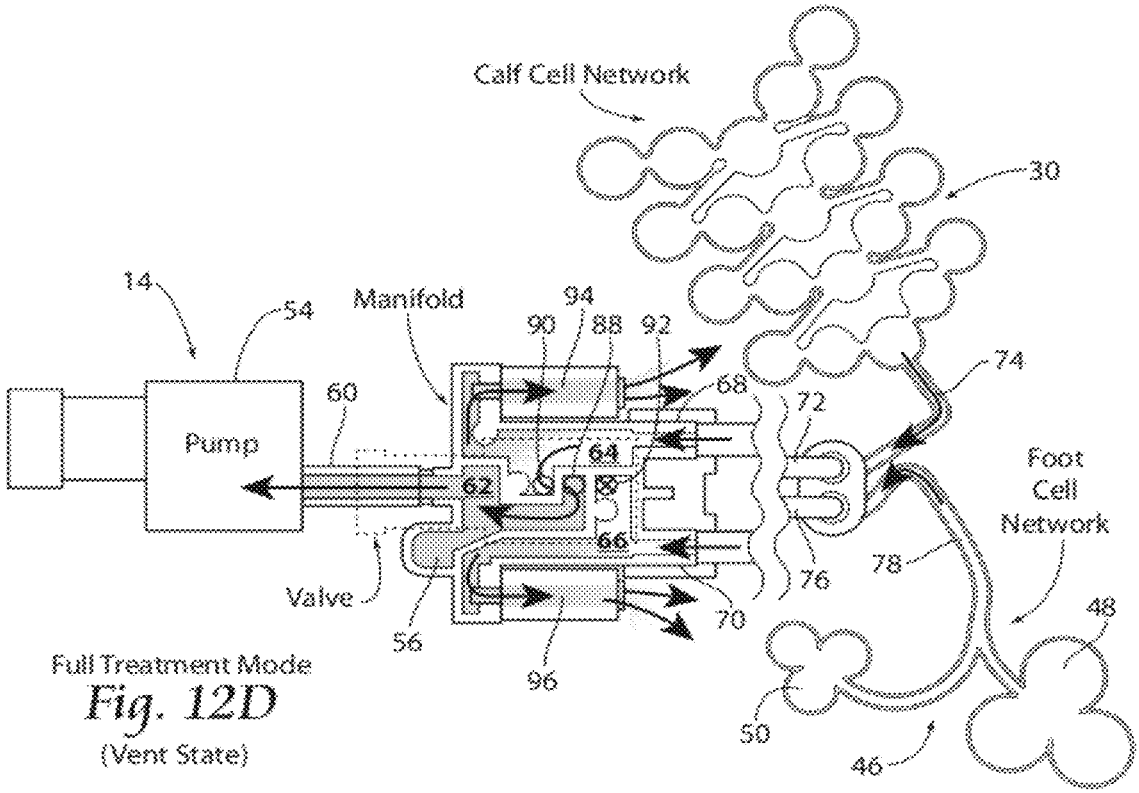
FIG. 12D is diagrammatic view of the operation of the pneumatic fluid source in a full treatment mode, governed by the controller, during the venting state, during which compressed pneumatic fluid are vented from the foot and calf regions of the pneumatic distribution garment.

At the end of the prescribed time period, the controller 16 commands the pump 54 to turn off, retains the valve assembly 58 in the de-energized condition to maintain the second valve state, and de-energizes the vent valves 94 and 96 to open the vent valves 96 and 98 (see FIG. 12D). The calf and foot air chambers 64 and 66 in the manifold 56 communicate directly with the atmosphere, and pressurized air residing in the foot and calf regions 20 and 22 are vented through these chambers 64 and 66 to the atmosphere.

The controller 16 waits for a prescribed delay period (e.g., about 35 to 90 seconds, but could be as much as about 240 seconds). During (or at the end of) the prescribed delay period, the controller 16 commands the vent valves 94 and 96 to close, and sets the valve assembly 58 to the first valve state (see FIG. 12A). At the end of the delay period, the controller 16 activates the pump 54 and begins the sequential process anew.

The controller 16 continuously repeats the process for a prescribed period, as prescribed by a physician or caregiver, which can be, e.g., 20 to 24 hours per day. The prescribed treatment period will vary according to different disease states and the particular condition of the individual being treated. In each treatment regime, two pneumatic fluid distribution garments 12 can be worn, one on the left leg and one on the right leg (as FIG. 1A shows). Each garment 12 has its own dedicated pneumatic fluid source 14 and controller 16 and can thereby operate independent of each other. Alternatively, if desired, the microprocessor 112 can include embedded code expressing pre-programmed rules or algorithms supporting a wireless communication link between the two controllers 16, to configure one controller 16 as a master and the other controller 16 as a slave, to provide a phased coordination of distribution of pressurized pneumatic pressure to the networks of the left and right garments 12 in a desired manner.

B. Mobility Mode

Mobility is critical to patient recovery. The system 10 does not hinder, but rather encourages, mobility by its compact and ambulatory design, to enhance patient protection from DVT development.

Current patient populations receiving high DVT risk surgeries (e.g.: orthopedics and limb trauma) are now healthier and younger than their predecessors. Thus their systems respond well to prophylaxis treatments. Patients are spending less time in the hospital for their recovery. This transition to rehabilitation clinics and/or home care must include prophylaxis treatment against DVT. There are few, if any, devices available for meeting the mobility needs of patients in recovery.

When the mobility mode is desired, the individual is instructed to either detach/fold away the foot region 22 of the garment 12 or continue to wear the foot region 22. The patient is directed to set the controller 16 to the mobility mode, to allow the patient to ambulate while pressure is applied only to the calf region.

Figure 12E:
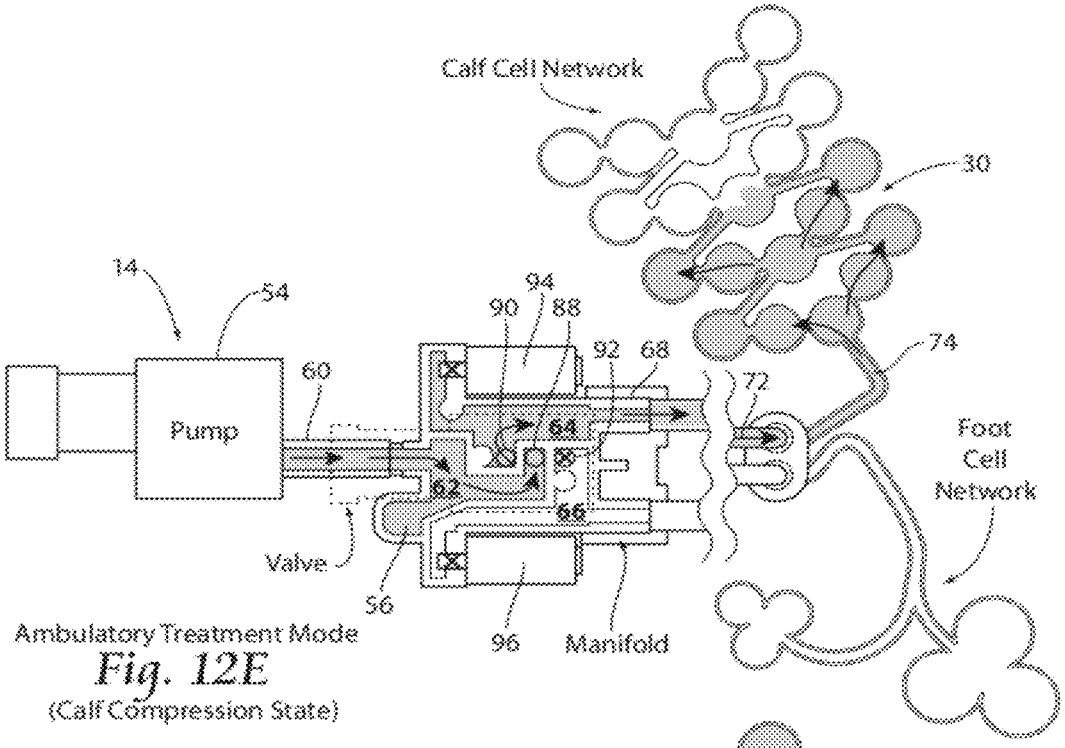
FIGS. 12E and 12F are diagrammatic views of the operation of the pneumatic fluid source in a mobility treatment mode, governed by the controller, during the calf compression state, during which compressed pneumatic fluid is conveyed into the calf region of the pneumatic distribution garment.

In the mobility mode, the controller 16 activates the pneumatic pump 54, commands the vent valves 94 and 96 to close (by energizing the vent valves 94 and 96), and de-energizes the valve assembly 58 to establish the second valve state (see FIG. 12E). The controller 16 monitors pressure sensed by the transducer 110 in the pilot air chamber 62 to assure that the pump 54 is operational and supplying pressurized air into the pilot air chamber 62.

Figure 12F:
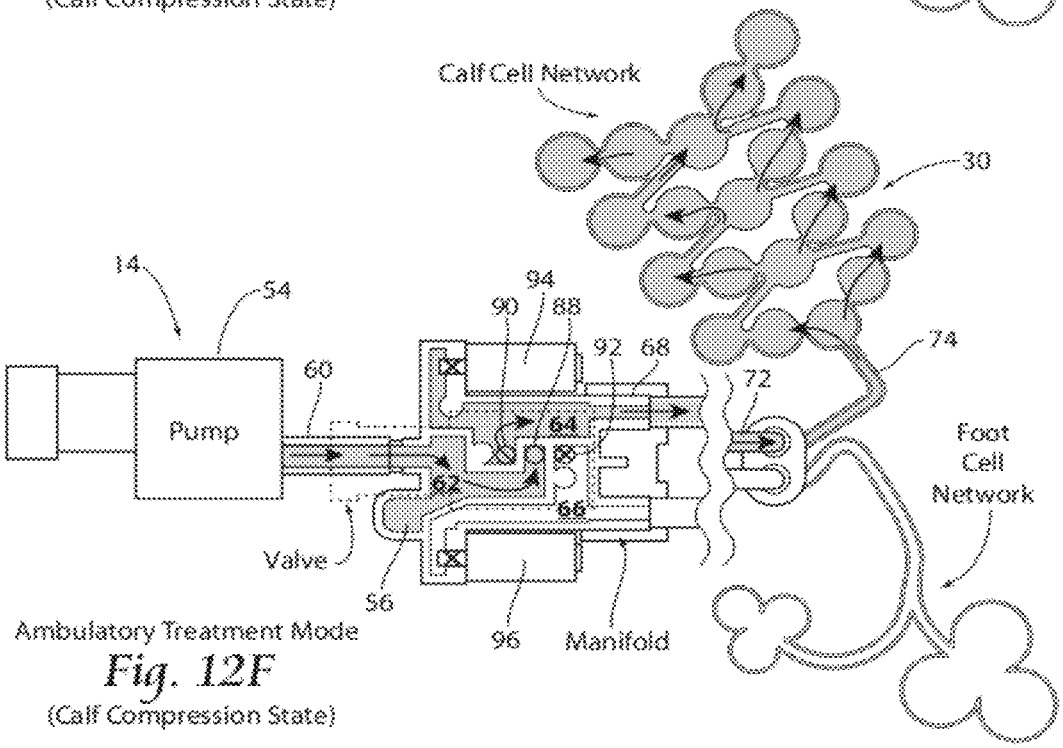

Pressurized air is directed through the pilot air chamber 62 only into the calf network air chamber 64, through the calf air chamber outlet 68, and into the network 30 of the calf region 20. The controller 16 maintains this condition for a prescribed time period (e.g., about 5 to 8 seconds) to allow pressurized air to advance laterally and proximally in the network of the calf region 20 (see FIGS. 12E and 12F), as previously described.

Figure 12G:
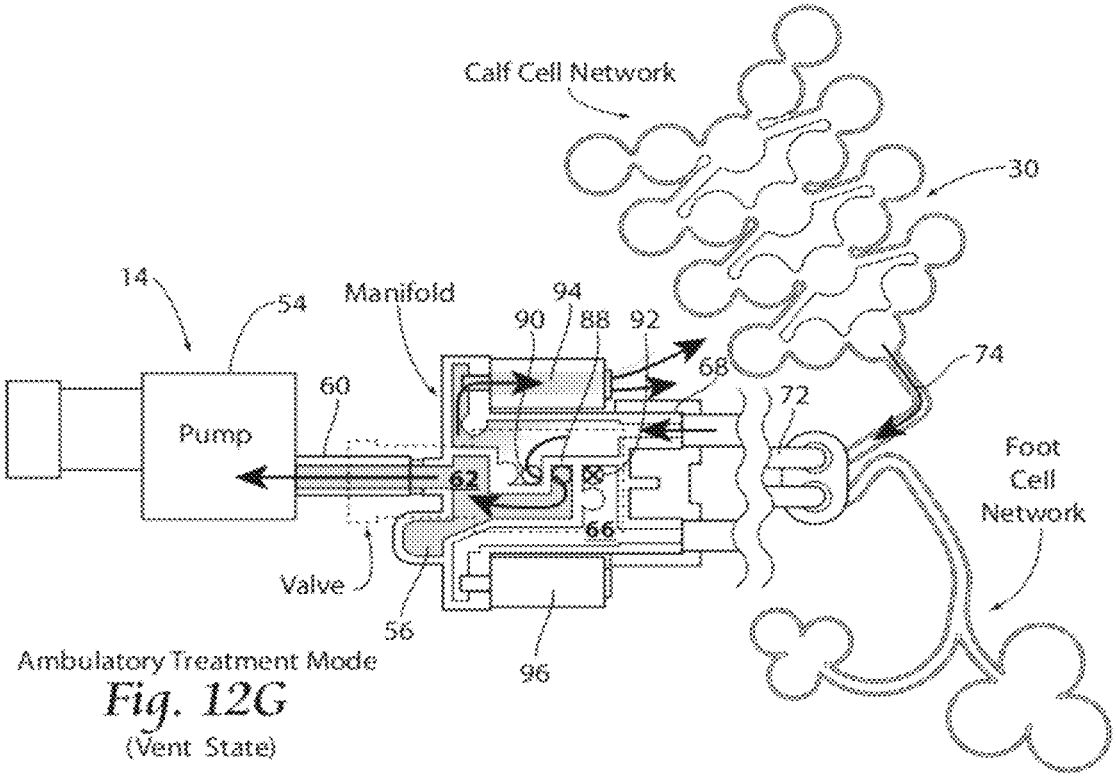
FIG. 12G is diagrammatic view of the operation of the pneumatic fluid source in a mobility treatment mode, governed by the controller, during the venting state, during which compressed pneumatic fluid are vented from the calf region of the pneumatic distribution garment.
Figure 13:
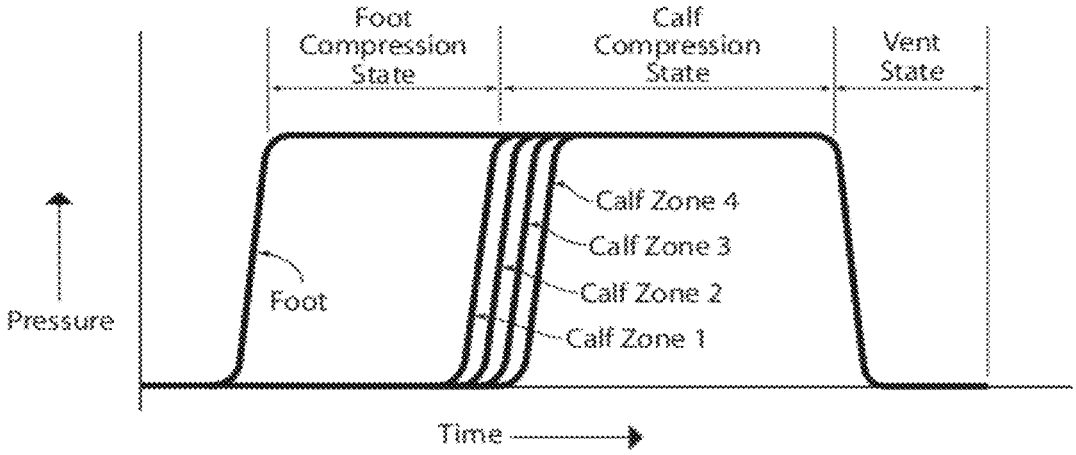
FIG. 13 is a graph showing the distribution of pneumatic pressure over time within the pneumatic distribution garment.

At the end of the prescribed time period, the controller 16 commands the pump 54 to turn off, maintains the valve assembly 58 in a de-activated condition to retain in the second valve state (see FIG. 12G) and opens the vent valves 94 and 96 (by de-activating the vent valves 94 and 96). The calf air chamber 64 in the manifold 56 communicates directly with the atmosphere, and pressurized air residing in the calf region 20 is vented through the chamber 64 to the atmosphere.

The controller 16 waits for a prescribed delay period (e.g., about 35 to 90 seconds, but could be as much as about 240 seconds)). During the prescribed delay period, the controller 16 commands the vent valves 94 and 96 to close (by activating the vent valves 94 and 96), and maintains the valve assembly 58 in a de-activated condition to retain the second valve state (see FIG. 12E). At the end of the delay period, the controller 16 activates the pump 54 and begins the sequential process for the mobility mode anew, repeating the sequence for a period of time prescribed by a physician or caregiver for the individual. During the treatment, the individual can freely ambulate, because the pneumatic fluid source 14 and controller 16 is carried on-board the garment 12.

As earlier described, in the mobility mode, two pneumatic fluid distribution garments 12 can be worn, one on the left calf and one on the right calf (as FIG. 1B shows). Each garment 12 has its own dedicated pneumatic fluid source 14 and controller 16 and can thereby operate independent of each other. Alternatively, if desired, the microprocessor 112 can include embedded code expressing pre-programmed rules or algorithms supporting a wireless communication link between the two controllers 16, to configure one controller 16 as a master and the other controller 16 as a slave, to provide a phased coordination of distribution of pressurized pneumatic pressure to the networks of the left and right garments 12 in a desired manner during the mobility mode.

Example

A study was performed to demonstrate the performance of a system 10 as described herein to increase femoral venous peak flow velocity (PFV) in healthy individuals. The study demonstrated a statistically significant increase in peak flow velocity (PFV) during the compression phase of treatment over the baseline measure of PFV. There were no adverse events observed during the study.

The system 10 evaluated comprised a pneumatic fluid distribution garment 12 like that shown in FIG. 2A, worn on the right calf and foot. The system 10 also includes a pneumatic fluid source 14 like that shown in FIGS. 9 and 10 and a controller 16 located wholly within a common control module 18 (as shown in FIG. 2B) carried wholly by the pneumatic fluid distribution garment 12. Thirty-three (33) individuals (55% women and 45% male) were treated. The average age was 35 years and ranged from 21 years to 63 years. Each individual was treated once on the right leg. For each individual, the procedure lasted approximately one hour.

PFV measurements for each individual were taken at four time points:

1. After five minutes rest with the non-activated device attached to the calf and foot (Baseline);
2. Immediately after the system 10 was activated, during the first treatment cycle (T=1);
3. A mid-point measurement between the initial and final cycles. (T=4-6);
4. A final measurement during the tenth treatment cycle, approximately 10 minutes of system activity (T=10).

The primary endpoint was the change in femoral venous peak flow velocity (PFV) with the activated system 10 compared to the femoral venous PFV at baseline prior to device activation, computed as the average of the three PFV measurements from the activated device minus the PFV prior to activation within each individual. The mean difference was compared to zero using the paired t-test or, if the difference is not normally distributed, using the Wilcoxon signed-rank test.

To provide a first secondary efficacy endpoint, each individual reported comfort of the system 10.

To provide a second secondary efficacy endpoint, femoral venous blood velocity augmentation was also determined, defined as the percent increase in femoral venous Peak Flow Velocity (PFV) during the compression phase of the treatment cycle compared to the PFV during the decompression phase of the treatment cycle.

The PFV was taken during the compression phase of the treatment. This PFV was then compared to the individual's own baseline PFV using a paired t-test. The average increase from baseline to the compression phase in PFV was 18.9 cm/s. The 95% confidence interval for the average increase in PFV was 16.3 cm/s to 21.6 cm/s. The t-statistic (14.59) was highly significant, with an associated p-value of less than 0.0001. This indicates that the increase in PFV discussed above was a statistically significant increase over the baseline values for each individual.

The first secondary endpoint addressed the comfort of the individual while the system 10 was being installed, during use of the system 10, and after use of the system 10. Each subject rated comfort on a 1 to 5 scale where 1 was "Negative" comfort and 5 was "Positive" comfort. The comfort of the system 10 scored very high. Comfort during installation was scored as all 4's and 5's, with a majority of 5's (n=31). The distribution of comfort scores during use was the same as the distribution during installation. There were thirty-one 5's and two 4's. All 33 subjects rated the comfort after use as a 5.

The second secondary endpoint was to characterize the PFV augmentation. This was done during the use of the system 10. PFV augmentation is defined as a percent increase of PFV during the compression phase relative to the PFV during the decompression phase. It was calculated as (PFV during compression minus the PFV during decompression) divided by the PFV during decompression*100. On average, the system augmented the PFV by a little over 175% and augmentation ranged from 69% to 344%. 25% of the individuals had a PFV augmentation of greater than 205%, and the median was approximately 156%. The lowest augmentation obtained in this study was 69%.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A method for applying pneumatic fluid pressure to the musculature of a limb to compress the musculature and augment blood flow velocity toward the heart, the method comprising (i) conveying pneumatic fluid pressure to a first medial zone, comprising a first core cell, of the musculature at the distal limb generally aligned with the longitudinal axis of the limb, (ii) progressively applying the pneumatic fluid pressure from the first core cell to the musculature along a first pair of right and left lateral paths communicating with the first core cell and branching from the first core cell about 15° to about 85° measured from the longitudinal axis of the limb, and not perpendicular to the longitudinal axis of the limb, so that the application of pneumatic fluid pressure by the first pair of left and right lateral paths is also progressively advanced along the musculature in a proximal direction toward the heart, (iii) directing the pneumatic fluid pressure along an intra-zone channel from the lateral-most right and left extents of the first pair of right and left lateral paths medially, at an angle of less than 90° from the first pair of right and left lateral paths, to a second medial zone, comprising a second core cell, of the musculature proximal to the first core cell and also generally aligned with the longitudinal axis of the limb, (iv) progressively applying the pneumatic fluid pressure from the second core cell to the musculature along second pair of right and left lateral paths communicating with the second core cell and branching from the second core cell about 15° to about 85° measured from the longitudinal axis of the limb, and not perpendicular to the longitudinal axis of the limb, so that the application of pneumatic fluid pressure also continues to be progressively advanced in a proximal direction in the second pair of left and right lateral paths toward the heart, (v) optionally, repeating (iii) and (iv) to apply the pneumatic fluid pressure to subsequent core cells and respective pairs of right and left lateral paths branching from each subsequent core cell about 15° to about 85° measured from the longitudinal axis of the limb, and not perpendicular to the longitudinal axis of the limb, so that the application of pneumatic fluid pressure continues to be progressively distributed both in a lateral direction and in a proximal direction toward the heart from distal limb to proximal limb, (vi) when the pneumatic fluid pressure reaches the lateral-most right and left extents of the right and left lateral paths at the proximal limb, venting the pneumatic fluid pressure from all core cells and respective right and left lateral paths, and (vii) repeating (i), (ii), (iii), (iv), (v) and (vi) for a prescribed time interval comprising a therapy session.

2. A method according to claim 1 wherein the musculature comprises a calf of a limb.

3. A method according to claim 1 wherein the respective right and left lateral paths include individual pneumatic cells.

4. A method according to claim 3 wherein the individual pneumatic cells comprise shapes selected among generally curvilinear and/or generally rectilinear shapes.

5. A method according to claim 3 wherein at least one of the individual pneumatic cells comprises a generally circular shape.

6. A method according to claim 1 wherein the core cells and respective right and left lateral paths in each zone collectively comprise a pneumatic distribution network having a total active fluid volume fitted to the musculature (AFV, expressed in ml) to apply an average compressive force to the musculature (ACF, expressed in mmHg), the pneumatic distribution network having a volume-to-compressive force ratio comprising AFV/ACF being equal to or less than 8 ml/mmHg.

7. A method according to claim 6 wherein the network is sized and configured to be fitted to a calf of a leg.

8. A method according to claim 1 further including, prior to (i), applying uniform pneumatic pressure to a dorsal surface and a plantar surface of a distal appendage of the limb in tandem to thereby augment blood flow velocity from the appendage into the limb and toward the heart, and during (vi), pneumatic fluid pressure is vented from the dorsal and a plantar surfaces of the distal appendage.

9. A method according to claim 8 wherein the pneumatic fluid pressure is applied to the dorsal and plantar surfaces of the distal appendage by individual pneumatic cell patterns.

10. A method according to claim 1 wherein performing (i) to (vii) is directed to achieving a therapeutic objective comprising at least one of the following; treating deep vein thrombosis; enhancing blood circulation in general; diminishing post-operative pain and swelling; reducing wound healing time; treatment and assistance in healing stasis dermatitis, venous stasis ulcers, and arterial and diabetic leg ulcers; treating chronic venous insufficiency; or reducing edema.

11. A method according to claim 1 further including providing a garment to be fitted to the musculature of a calf of a leg of an individual, the garment carrying a pneumatic distribution network including the core cells and respective right and left lateral paths sized and configured to overlie the musculature of the calf, and further including providing a pneumatic fluid source and a controller for the pneumatic fluid source together sized and configured to be carried wholly by the garment in communication with the pneumatic distribution network, the controller being programmed to direct the pneumatic fluid source to perform (i) to (vii) to apply pneumatic pressure to the musculature of the calf.

12. A method according to claim 11 further including directing an individual to ambulate while wearing the garment and while the controller directs the pneumatic fluid source to perform (i) to (vii) to apply pneumatic pressure to the musculature of the calf.

13. A method according to claim 11 wherein the garment includes a region sized and configured to be fitted to the dorsal and plantar surfaces of a foot, the region including a second pneumatic distribution network communicating with the pneumatic fluid source to direct pneumatic pressure to the dorsal and plantar surfaces of the foot, and wherein the controller is programmed to, prior to (i), apply pneumatic pressure through the second pneumatic distribution network to the dorsal surface and the plantar surface of the foot to thereby augment blood flow velocity from the appendage into the limb and toward the heart, and during (vi), to vent pneumatic fluid pressure from the second pneumatic fluid network.

14. A method according to claim 13 wherein the second pneumatic network includes at least one individual pneumatic cell pattern sized and configured to overlie a dorsal surface of the foot and at least one individual pneumatic cell pattern sized and configured to overlie a plantar surface of the foot.

15. A method according to claim 14 wherein the at least one individual pneumatic cell pattern sized and configured to overlie a plantar surface of the foot covers a larger area than the at least one individual pneumatic cell pattern sized and configured to overlie a dorsal surface of the foot.

16. A method according to claim 14 wherein at least one of the pneumatic cell patterns comprises a center region having a plurality of enlarged cell nodes that arch radially from the center region.

17. A method according to claim 14 wherein the at least one individual pneumatic cell pattern sized and configured to overlie a plantar surface of the foot plantar zone is sized and configured to overly a region of a sole of a foot in a region that is closer to the toes than to the heel.

18. A method according to claim 17 wherein the at least one individual pneumatic cell pattern sized and configured to overlie a dorsal surface of the foot dorsal zone is sized and configured to overlie a region of a top of a foot to a region that is closer to the toes than to the ankle.

* * * * *